US011525257B2

(12) United States Patent
Poh et al.

(10) Patent No.: US 11,525,257 B2
(45) Date of Patent: Dec. 13, 2022

(54) CONNECTION SYSTEM AND METHOD FOR PREFABRICATED VOLUMETRIC CONSTRUCTION MODULES

(71) Applicant: MRCB Innovations SDN, BHD, Kuala Lumpur (SG)

(72) Inventors: Qi Pin Poh, Singapore (SG); Choon Boon Kang, Singapore (SG); Seng Wei Seow, Singapore (SG)

(73) Assignee: MRCB Innovations SDN. BHD., Kuala Lumpur (MY)

( * ) Notice: Subject to any disclaimer, the term of this patent is extended or adjusted under 35 U.S.C. 154(b) by 534 days.

(21) Appl. No.: 16/322,687

(22) PCT Filed: Dec. 4, 2017

(86) PCT No.: PCT/SG2017/050594

§ 371 (c)(1),
(2) Date: Feb. 1, 2019

(87) PCT Pub. No.: WO2018/101891

PCT Pub. Date: Jun. 7, 2018

(65) Prior Publication Data

US 2021/0372115 A1 Dec. 2, 2021

(30) Foreign Application Priority Data

Dec. 2, 2016 (SG) ..... 10201610152Q
Sep. 19, 2017 (SG) ..... 10201707728X

(51) Int. Cl.
*E04H 1/00* (2006.01)
*E04B 1/348* (2006.01)
(Continued)

(52) U.S. Cl.
CPC ..... *E04B 1/3483* (2013.01); *E04B 1/40* (2013.01); *E04H 1/04* (2013.01)

(58) Field of Classification Search
CPC ..... E04B 1/40; E04B 1/3483
(Continued)

(56) References Cited

U.S. PATENT DOCUMENTS 3,500,595 A 3/1970 Bennett
4,599,829 A * 7/1986 DiMartino, Sr. ..... E04B 1/3483 52/106

(Continued)

FOREIGN PATENT DOCUMENTS

CN 204163192 U 2/2015
CN 205116417 U 3/2016

(Continued)

OTHER PUBLICATIONS

International Search Report, Intellectual Property Office of Singapore, International Application No. PCT/SG2017/050594, dated Jan. 1, 2018, 12 pages.

*Primary Examiner* — Basil S Katcheves
(74) *Attorney, Agent, or Firm* — Wood Herron & Evans LLP

(57) ABSTRACT

The invention provides a prefabricated volumetric construction module having connection mechanism for securing to other similar modules. A prefabricated volumetric construction module includes a self-supporting structure and pairs of corner castings arranged at least at the corners of the structure. During building construction, the modules are assembled and secured together using connection rods and interlocking plates to provide vertical securement between vertically adjoining modules and horizontal securement between horizontally adjoining modules.

6 Claims, 30 Drawing Sheets

(51) Int. Cl.
*E04B 1/41* (2006.01)
*E04H 1/04* (2006.01)

(58) Field of Classification Search
USPC ..... 52/79.13
See application file for complete search history.

(56) References Cited

U.S. PATENT DOCUMENTS

| | | | | |
|---|---|---|---|---|
| 5,816,011 | A | 10/1998 | Kuramoto | |
| 2005/0034390 | A1 | 2/2005 | Dubensky et al. | |
| 2008/0216426 | A1 | 9/2008 | Bunker | |
| 2011/0173907 | A1* | 7/2011 | Katsalidis | E04B 1/34869 52/741.1 |
| 2012/0279141 | A1* | 11/2012 | Wiederick | E04H 5/02 52/79.5 |
| 2014/0123573 | A1 | 5/2014 | Farnsworth | |
| 2015/0322668 | A1* | 11/2015 | Quinn | E02D 27/00 52/236.9 |
| 2016/0160515 | A1* | 6/2016 | Wallance | E04F 10/10 52/745.02 |
| 2017/0198489 | A1* | 7/2017 | Klein | E04B 1/34384 |
| 2019/0194932 | A1* | 6/2019 | Russell | E04B 1/74 |

FOREIGN PATENT DOCUMENTS

| | | | |
|---|---|---|---|
| CN | 105908840 | A | 8/2016 |
| GB | 1341559 | A | 12/1973 |
| GB | 2329649 | A | 3/1999 |
| GB | 2438806 | A | 12/2007 |

* cited by examiner

CONNECTION SYSTEM AND METHOD FOR PREFABRICATED VOLUMETRIC CONSTRUCTION MODULES

FIELD OF INVENTION

Embodiments of the invention relate to prefabricated volumetric construction modules having connection mechanism for securement with other modules, building construction utilizing such modules and methods for assembling or erecting such building construction.

BACKGROUND

In sharp contrast to rapid development of technology in many other fields, construction technology has proceeded at a relatively slow pace over the last half century. Construction industry remains labour-intensive and of a handcraft nature and, as a result, housing and building costs have remained very high.

Prefabrication has been cited as a potential solution, but many prefabrication proposals to date have not proven to be commercially successful and relatively few prefabrication techniques have been adopted by the industry. Prefabrication techniques fall under two major categories, namely, steel structure module construction and pre-cast volumetric concrete modules.

These prefabrication systems tend to be costly, requiring expensive prefabrication factories and relatively expensive handling and erection equipment and techniques. To be viable such concepts usually require a very high degree of repetition.

One common problem which remains largely unsolved is that the existing prefabricated systems provide only limited architectural and space flexibility.

CROSS-REFERENCE TO RELATED APPLICATIONS

This application is a submission under 35 U.S.C. § 371 of International Application No. PCT/SG2017/050594, filed Dec. 4, 2017, the disclosure of which is hereby expressly incorporated by reference herein in its entirety.

SUMMARY

According to a first aspect of the invention, a prefabricated volumetric construction module is provided and comprises:

a plurality of beams and columns joined together to provide a self-supporting structure;

a plurality of pairs of upper and lower corner castings, each pair is arranged at distal ends of a column and adapted to receive therethrough a first connection rod having an internally threaded socket head and an externally threaded tail, wherein threads of the socket head and the tail are complementary, wherein the upper corner casting is adapted to engage the socket head, and the lower corner casting is adapted to allow the tail penetrate therethrough to threadably engage with an internally threaded socket head of a second connection rod, which is engaged with an upper corner casting of a vertically adjoining module, to provide vertical securement between the prefabricated volumetric construction module and the vertically adjoining module.

According to one embodiment of the first aspect, the upper corner casting includes a first upper plate having a first upper plate opening, a first lower plate having a first lower plate opening and a passageway extending between the first upper plate opening and the first lower plate opening, wherein the first lower plate opening is smaller than the first upper plate opening such that the lower plate is adapted to prevent the socket head of the first connection rod from penetrating the lower plate.

According to one embodiment of the first aspect, the lower corner casting includes a second upper plate having the second upper plate opening, a second lower plate having the second lower plate opening and a passageway extending between the second upper plate opening and the second lower plate opening, wherein the second lower plate opening is adapted to allow penetration of the socket head of the second connection rod.

According to one embodiment of the first aspect, each module further comprises:

at least one cross-bracing joining the beams and columns;

a plurality of roof purlins joining upper ones of the beams;

at least one roof mounted to the roof purlins;

a plurality of floor joists joining lower ones of the beams; and at least one floor mounted to the floor joists.

According to one embodiment of the first aspect, at least some of the pairs of upper and lower corner castings are arranged at corners of the self-supporting structure.

According to one embodiment of the first aspect, remaining ones of the pairs of upper and lower corner castings are arranged adjacent to the at least some of the pairs of upper and lower corner castings.

According to a second aspect of the invention, a building structure is provided and comprises:

a plurality of pre-fabricated volumetric construction modules including vertically adjoining modules, wherein each module comprises:

a plurality of beams and columns joined together to provide a self-supporting structure;

a plurality of pairs of upper and lower corner castings, each pair is arranged at distal ends of a column, a plurality of first connection rods, wherein each first connection rod secures an upper-level module of the vertically adjoining modules with an adjoining lower-level module to provide vertical securement therebetween, wherein each first connection rod penetrates both an upper corner casting and a lower corner casting of a respective pair of corner castings at the upper-level module, each first connection rod having an internally threaded socket head and an externally threaded tail, wherein the socket head is engaged with the upper corner casting at the upper-level module and the tail is threadably engaged with an internally threaded socket head of another connection rod which is engaged with the upper corner casting of the adjoining lower-level module.

According to one embodiment of the second aspect, the building structure further comprises:

at least one interlocking plate having a main plate, at least one interlocking plate opening formed therein and at least one guide projection arranged at least partially around the interlocking plate opening, wherein the interlocking plate is interposed between the upper-level module and the adjoining lower-level module, wherein the internally thread socket head of the other connection rod is fitted within the interlocking plate opening, and wherein an upper and a lower portion of the guide projection are fitted within the lower corner casting of the upper-level module and upper corner casting of the lower-level module respectively.

According to one embodiment of the second aspect, the building structure further comprises:

at least one interlocking plate having a main plate, at least one interlocking plate opening formed therein and at least one guide projection arranged at least partially around the interlocking plate opening, wherein the interlocking plate is interposed between horizontally adjoining upper-level modules of the vertically adjoining modules and horizontally adjoining lower-level modules which vertically adjoin the horizontally adjoining upper-level modules, and wherein the internally thread socket head of the other connection rod is fitted within the interlocking plate opening to provide horizontal securement between the horizontally adjoining upper-level modules and further between the horizontally adjoining lower-level modules, and wherein an upper and a lower portion of the guide projection are fitted within the lower corner casting of the upper-level module and upper corner casting of the lower-level module respectively.

According to one embodiment of the second aspect, the building structure further comprises: a core structure constructed on-site and secured to at least one of the modules.

According to one embodiment of the second aspect, each module further comprises:

at least one cross-bracing joining the beams and columns;

a plurality of roof purlins joining upper ones of the beams;

at least one roof mounted to the roof purlins;

a plurality of floor joists joining lower ones of the beams; and at least one floor mounted to the floor joists.

According to one embodiment of the second aspect, at least some of the pairs of upper and lower corner castings are arranged at corners of the self-supporting structure.

According to one embodiment of the second aspect, remaining ones of the pairs of upper and lower corner castings are arranged adjacent to the at least some of the pairs of upper and lower corner castings.

According to one embodiment of the second aspect, each module is provided with architectural finishes including interior decoration and fixtures.

According to a third aspect of the invention, a method for constructing a building structure is provided and comprises:

stacking at least one upper-level pre-fabricated volumetric construction module on at least one lower-level module to provide vertically adjoining modules, wherein each module comprises:

a plurality of beams and columns joined together to provide a self-supporting structure;

a plurality of pairs of upper and lower corner castings, each pair is arranged at distal ends of a column, providing vertical securement between the vertically adjoining modules by:

using a plurality of connection rods, penetrating each connection rod through an upper corner casting and a lower corner casting of a respective pair of corner castings of the upper-level module, each connection rod having an internally threaded socket head and an externally threaded tail;

threadably engaging the tail with an internally threaded socket head of an other connection rod which is engaged with an upper corner casting of the lower-level module.

According to one embodiment of the third aspect, before stacking at least one upper-level pre-fabricated volumetric construction module on at least one lower-level module to provide vertically adjoining modules, the method further comprises:

arranging at least one interlocking plate between the upper-level module and the lower-level module, wherein the interlocking plate includes a main plate, at least one interlocking plate opening formed therein and at least one guide projection arranged at least partially around the interlocking plate opening; and fitting the socket head of the other connection rod within the interlocking plate opening and fitting a lower portion of the guide projection within the upper corner casting of the lower-level module.

According to one embodiment of the third aspect, before stacking at least one upper-level pre-fabricated volumetric construction module on at least one lower-level module to provide vertically adjoining modules, the method further comprises:

providing horizontal securement between horizontally adjoining upper-level modules and further between horizontally adjoining lower-level modules by:

arranging at least one interlocking plate between the horizontally adjoining upper-level modules of the vertically adjoining modules and the horizontally adjoining lower-level modules which vertically adjoin the horizontally adjoining upper-level modules, wherein the interlocking plate includes a main plate, at least one interlocking plate opening formed therein and at least one guide projection arranged at least partially around the interlocking plate opening; and fitting the socket head of the other connection rod within the interlocking plate opening and fitting a lower portion of the guide projection within the upper corner casting of the lower-level module.

According to one embodiment of the third aspect, stacking at least one upper-level pre-fabricated volumetric construction module on at least one lower-level module to provide vertically adjoining modules further includes:

fitting an upper portion of the guide projection within the lower corner casting of the upper-level module.

According to one embodiment of the third aspect, the step of stacking at least one upper-level pre-fabricated volumetric construction module on at least one lower-level module to provide vertically adjoining modules further includes:

fitting an upper portion of the guide projection within the lower corner casting of the upper-level module.

According to one embodiment of the third aspect, the method further comprises: securing at least one of the modules to a core structure which is built on-site.

According to one embodiment of the third aspect, each module further includes:

at least one cross-bracing joining the beams and columns;

a plurality of roof purlins joining upper ones of the beams;

at least one roof mounted to the roof purlins;

a plurality of floor joists joining lower ones of the beams; and at least one floor mounted to the floor joists.

BRIEF DESCRIPTION OF DRAWINGS

It will be convenient to further describe the present invention with respect to the accompanying drawings that illustrate possible arrangements of the invention. Other arrangements of the invention are possible and consequently, the particularity of the accompanying drawings is not to be understood as superseding the generality of the preceding description of the invention.

DETAILED DESCRIPTION OF EMBODIMENTS OF THE INVENTION

Figure 1A:
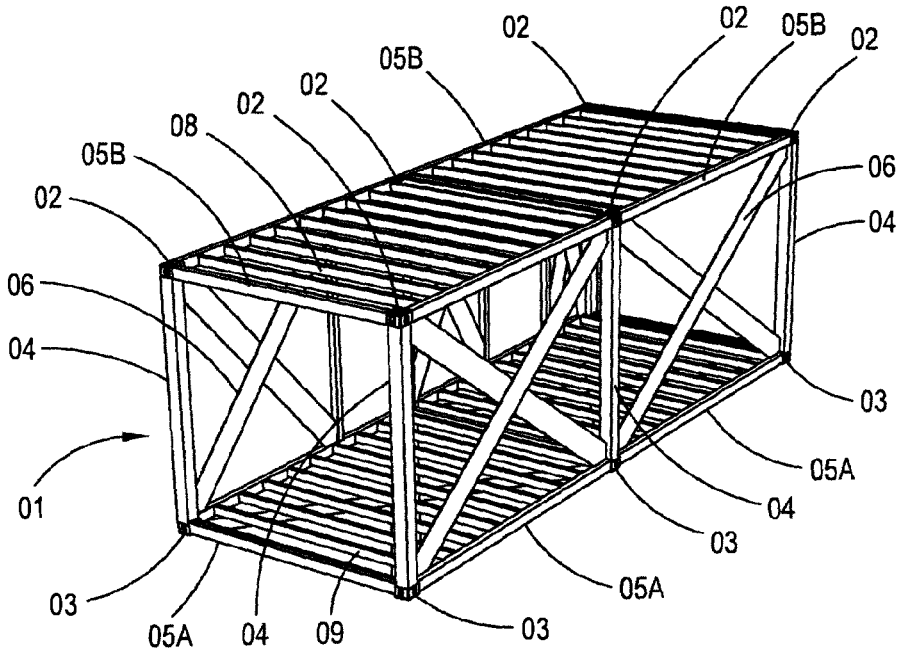
FIG. 1A shows a prefabricated volumetric construction module according to one embodiment of the invention.

In the following description, numerous specific details are set forth in order to provide a thorough understanding of various illustrative embodiments of the invention. It will be understood, however, to one skilled in the art, that embodiments of the invention may be practiced without some or all of these specific details. It is understood that the terminology used herein is for the purpose of describing particular embodiments only, and is not intended to limit the scope of the invention. In the drawings, like reference numerals refer to same or similar functionalities or features throughout the several views.

It should be understood that the terms "comprising", "including", "includes" and "having" are intended to be open-ended and mean that there may be additional elements other than the listed elements. Use of identifiers such as first, second, third and fourth should not be construed in a manner imposing any relative position or time sequence between limitations. Furthermore, terms such as "top", "bottom", "front", "back", "side", "end", "under", "upper", "lower" used herein are merely for ease of description and refer to the orientation of the components as shown in the figures. It should be understood that any orientation of the components described herein is within the scope of the invention. Furthermore, the term "adjoining" is intended to mean adjacent to or next to in any direction regardless of any direct or indirect contact or connection with the reference object.

Figure 1B:
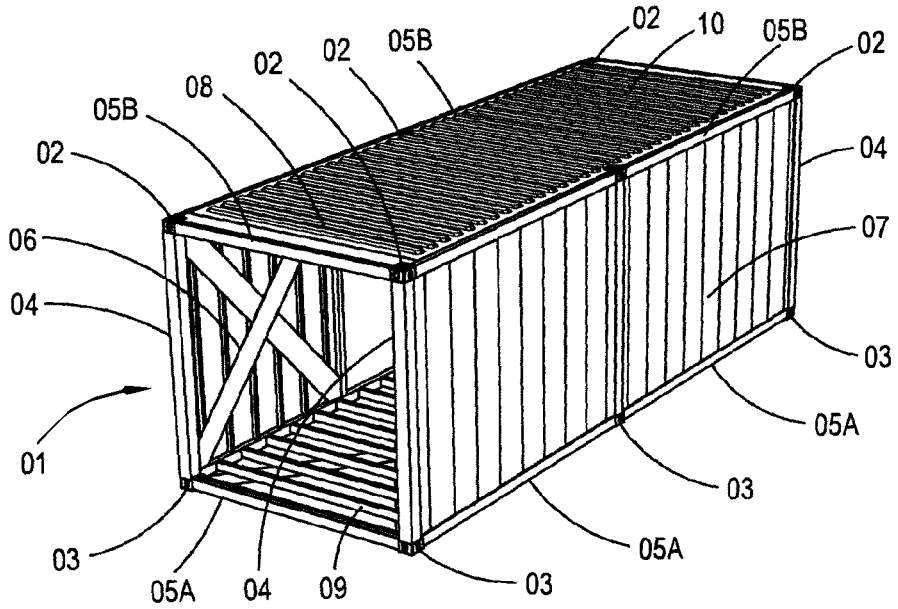
FIG. 1B shows the module of FIG. 1A provided with a roof and a side wall.
Figure 1C:
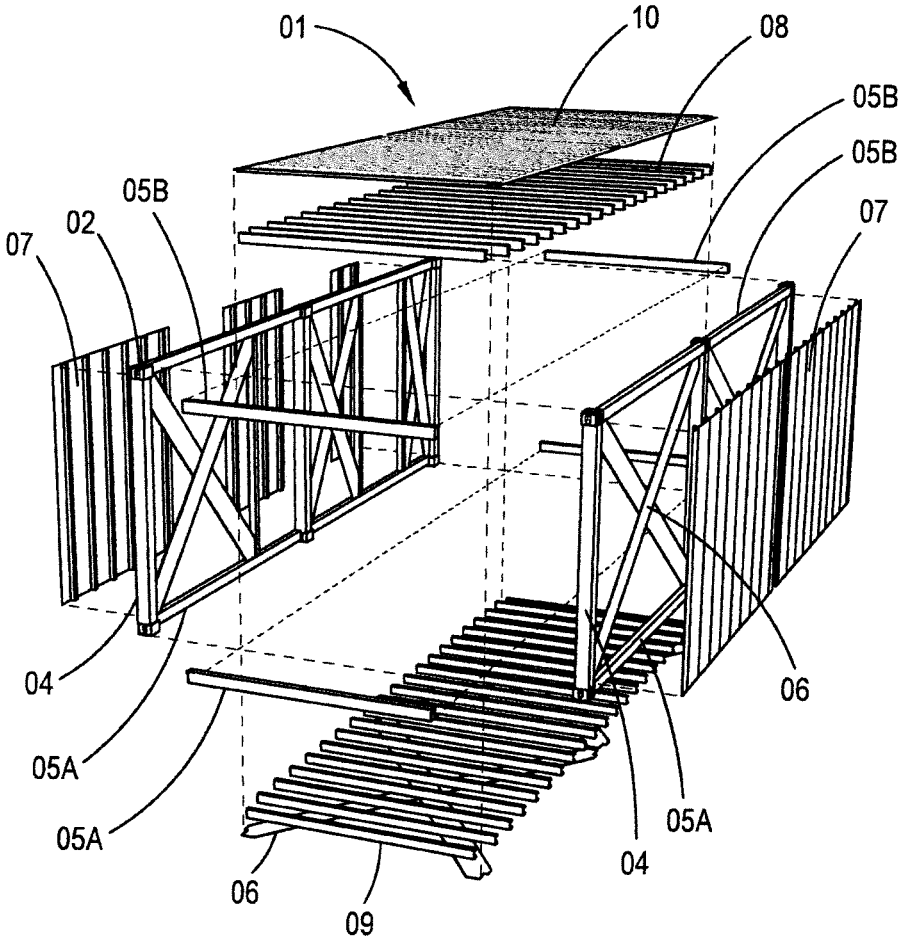
FIG. 1C shows an exploded view of the module of FIG. 1B.

According to one aspect of the invention, a prefabricated volumetric construction module 1 having connection mechanism is provided and illustrated in FIGS. 1A to 1C. A prefabricated volumetric construction module 1 includes a plurality of columns and beams 5A, 5B and columns 4 joined together, to provide a self-supporting structure. The self-supporting structure at least defines a top, a bottom, opposite sides and opposite ends. Upper beams may be provided as top rails 5A, and lower beams may be provided as bottom rails 5B. Columns 4 are provided as hollow posts to provide a passageway therethrough.

The module 1 may further include one or more cross-bracings 6 joining the beams and columns 4. The module 1 may further include one or more roof purlins 8 joining upper beams and one or more roofs 10, e.g. corrugated roof or ceiling boards 16, mounted to the roof purlins 8. The module 1 may further include one or more floor joists 9 joining lower beams 5B and one or more floor boards 15 mounted to the floor joists 9.

Figure 2A:
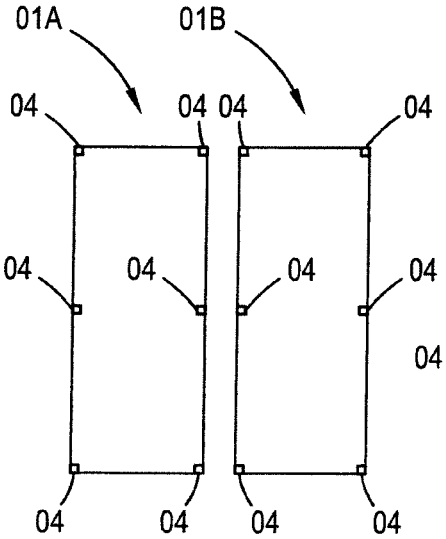
FIG. 2A shows a plan view of two unsecured modules and locations of corner castings.

The module 1 includes a plurality of pairs of corner castings 2, 3. The pairs of corner castings 2, 3 are arranged at corners of the module 1 and, optionally, at a mid-point position or other positions along the length of the module 1 (see FIG. 2A). In some embodiments, it is to be appreciated that two or more pairs of corner castings may be arranged adjacent to each other (see FIG. 15).

Each pair of corner castings 1, 2 includes an upper corner casting 2 and a lower corner casting 3 which are arranged at distal ends of a column 4.

The upper corner casting 2 includes a first upper plate, a first lower plate, first front plates and first side plates (see FIGS. 9A to 9D) joined or cast together to provide a casting housing. The first upper plate is provided with a first upper plate opening 215, and the first lower plate is provided with a first lower plate opening 214. A passageway extends between the first upper plate opening 215 and the first lower plate opening 214. The first lower plate opening 214 is smaller than the first upper plate opening 215. Dimensions of the first upper plate opening 215 are adapted to allow penetration of a socket head 210 of an elongate connection rod 11 while dimensions of the first lower plate opening 214 are adapted to prevent penetration of the socket head 210. Dimensions of both the first upper plate opening 215 and the lower plate opening 214 are adapted to allow penetration of a tail of the connection rod. One of the first front plates is provided with a first front plate opening 216. One of the first side plates is provided with a first side plate opening 217. The first front plate opening 216 and the first side plate opening 217 lead to the passageway to provide access to the connection rod 11 when it is inserted through the passageway.

The lower corner casting 3 includes a second upper plate, a second lower plate, second front plates and second side plates (see FIGS. 10A to 10D) joined or cast together to provide a casting housing. The second upper plate is provided with a second upper plate opening 218, and the second lower plate is provided with a second lower plate opening 219.

A passageway extends between the second upper plate opening 218 and the second lower plate opening 219. The second lower plate opening 219 is larger than the second upper plate opening 218. Dimensions of the second upper plate opening 218 are adapted to allow penetration of a tail of an elongate connection rod 11 and, optionally, prevent penetration of a socket head 210 of the connection rod. Dimensions of the second lower plate opening 219 are adapted to allow penetration of the socket head 210. Dimensions of both the second upper plate opening 218 and the second lower plate opening 219 are adapted to allow penetration of a tail of the connection rod. One of the second front plates is provided with a second front plate opening 220. One of the second side plates is provided with a second side plate opening 221. The second front plate opening 220 and the second side plate opening 221 lead to the passageway to provide access to the connection rod 11 when it is inserted through the passageway.

Figure 3A:
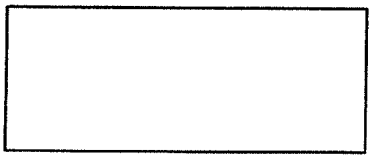
FIGS. 3A to 3E show various shapes for prefabricated volumetric construction modules.
Figure 3B:
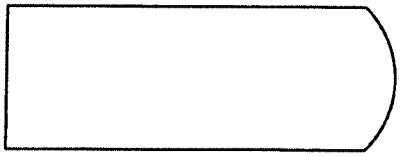
Figure 3C:
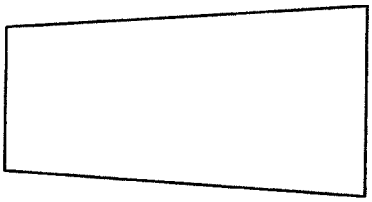
Figure 3D:
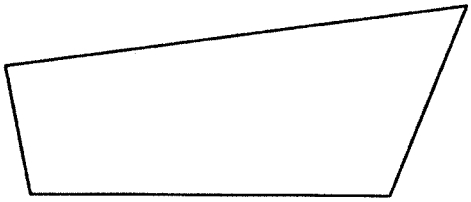
Figure 3E:
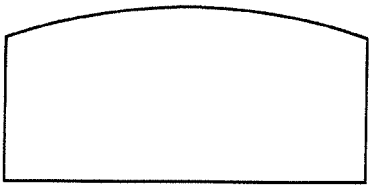
Figure 4A:
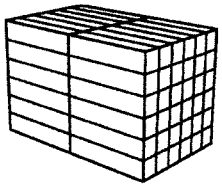
FIGS. 4A to 4H show various examples of building structures constructed from prefabricated volumetric construction modules.
Figure 4B:
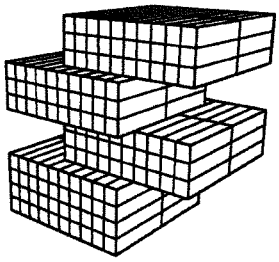
Figure 4C:
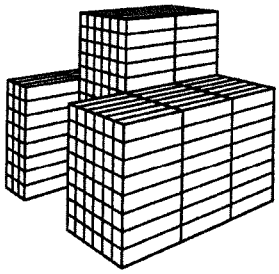
Figure 4D:
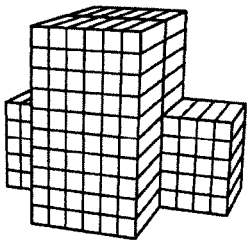
Figure 4E:
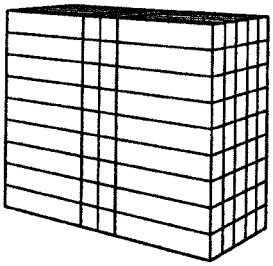
Figure 4F:
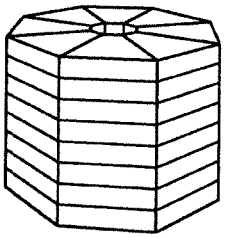
Figure 4G:
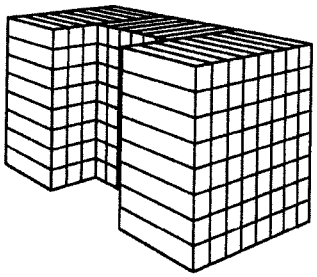
Figure 4H:
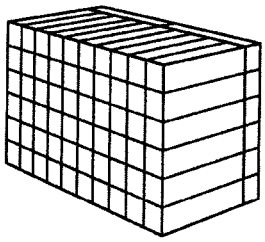
Figure 5A:
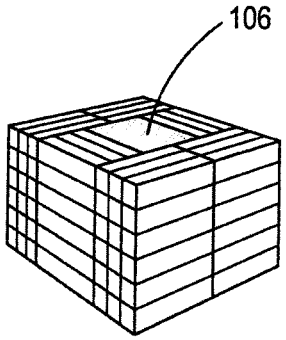
FIGS. 5A to 5E show various examples of building structures constructed from one or more concrete cores and prefabricated volumetric construction modules secured thereto.
Figure 5B:
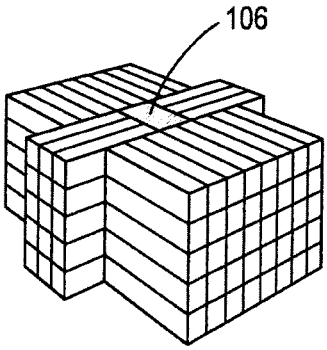
Figure 5C:
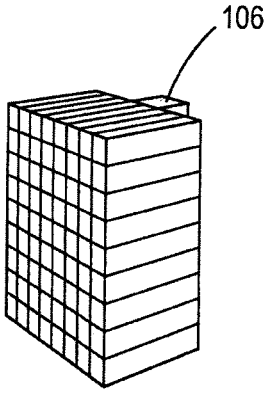
Figure 5D:
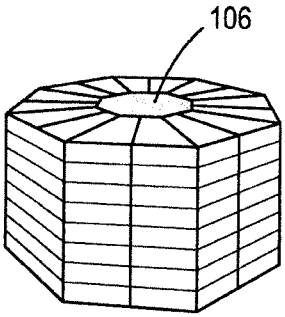
Figure 5E:
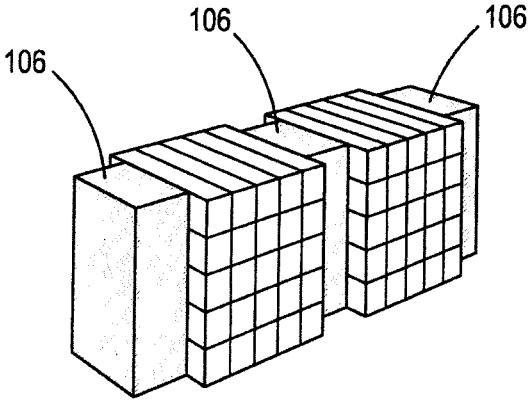

While the modules 1 of FIGS. 1A to 1C are illustrated as having cuboid shape (see FIG. 3A), it is to be appreciated that the modules 1 may take on other shapes, such as the various shapes illustrated in FIGS. 3B to 3E.

The aforementioned prefabricated volumetric construction modules 1 may also be construed as prefabricated pre-finished volumetric construction modules (PPVC) in which architectural finishes including interior decorations and fixtures are installed offsite in the modules at the factory before the prefabricated pre-finished volumetric construction modules (PPVC) are transported and assembled on-site.

Figure 8B:
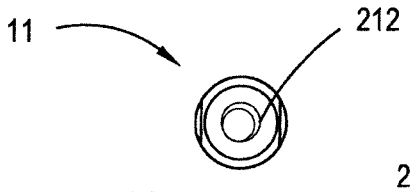
FIG. 8B is a side view of the rod of FIG. 8A.
Figure 8C:
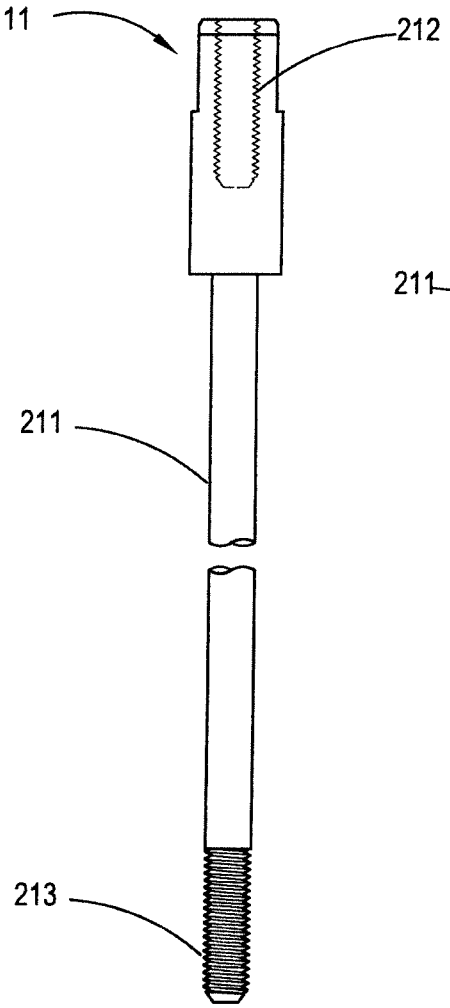
FIG. 8C is a top view of the rod of FIG. 8A.
Figure 8A:
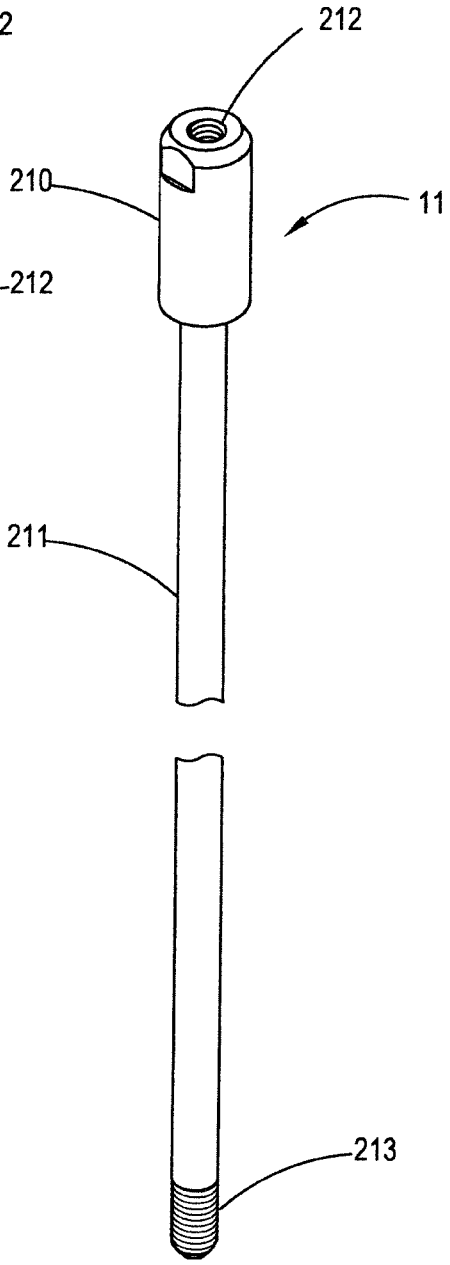
FIG. 8A is a perspective view of a connection rod according to one embodiment of the invention.
Figure 9B:
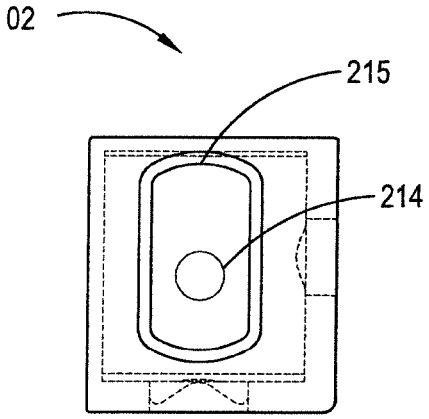
FIG. 9B is a top view of the upper corner casting of FIG. 9A.
Figure 9A:
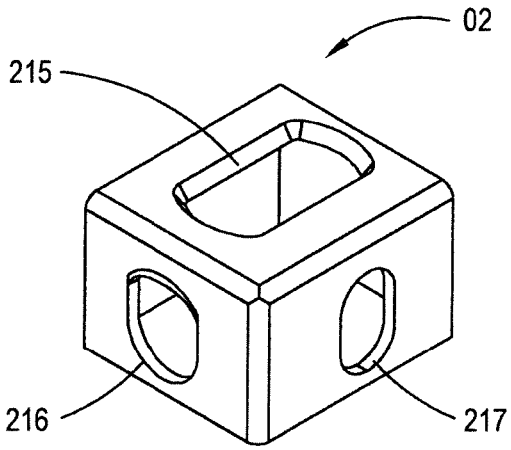
FIG. 9A is a perspective view of an upper corner casting according to one embodiment of the invention.
Figure 9C:
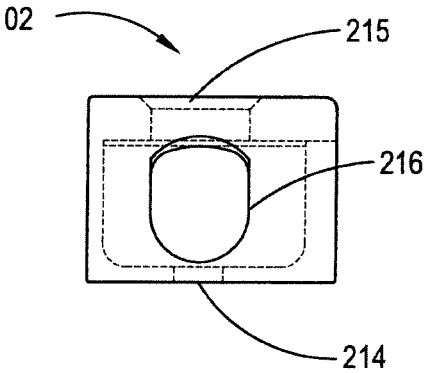
FIG. 9C is a side view of the upper corner casting of FIG. 9A.
Figure 9D:
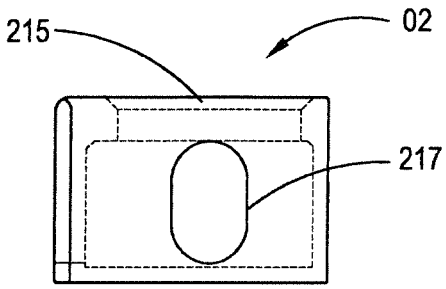
FIG. 9D is a side view of the upper corner casting of FIG. 9A.
Figure 10B:
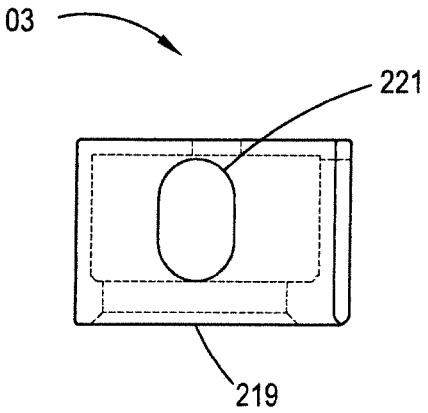
FIG. 10B is a top view of the lower corner casting of FIG. 10A.
Figure 10A:
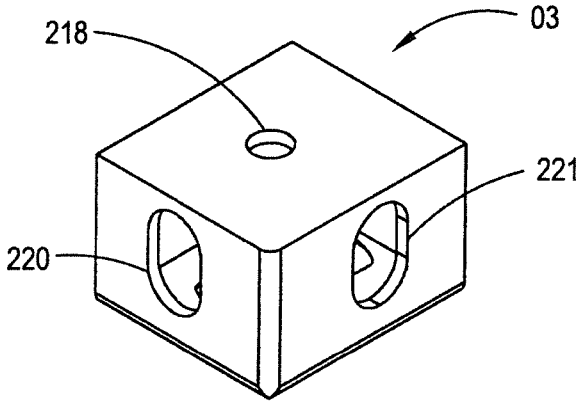
FIG. 10A is a perspective view of a lower corner casting according to one embodiment of the invention.
Figure 10C:
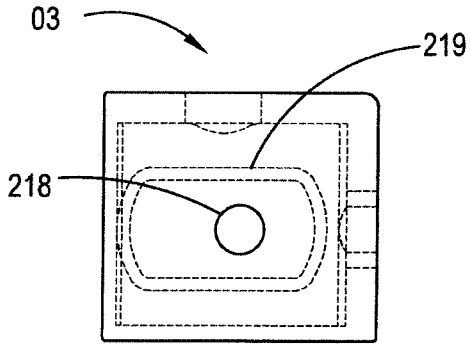
FIG. 10C is a side view of the lower corner casting of FIG. 10A.
Figure 10D:
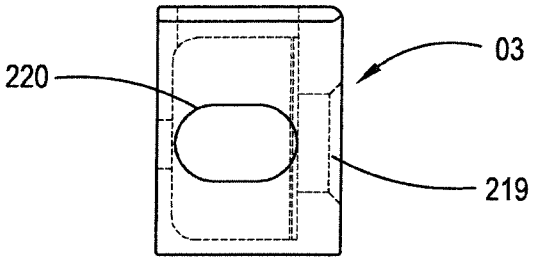
FIG. 10D is a side view of the upper corner casting of FIG. 10A.
Figure 11A:
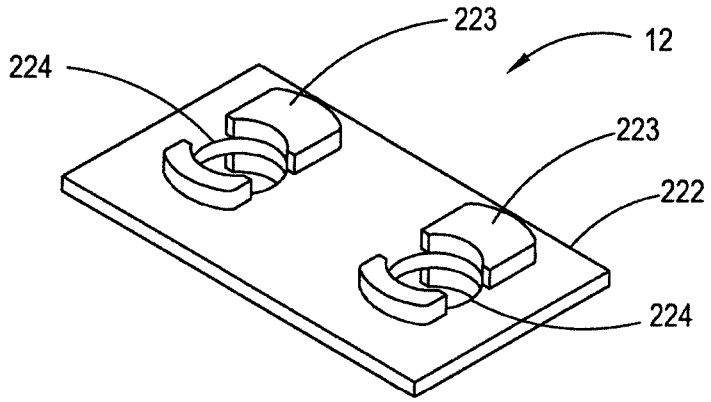
FIG. 11A is a perspective view of an interlocking plate according to one embodiment of the invention.
Figure 11B:
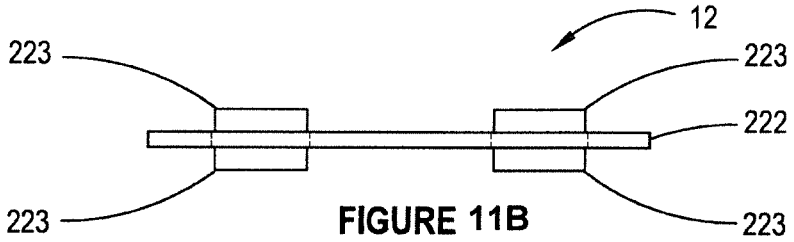
FIG. 11B is a side view of the interlocking plate of FIG. 11A.
Figure 11C:
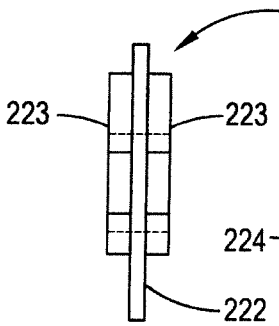
FIG. 11C is a side view of the interlocking plate of FIG. 11A.
Figure 11D:
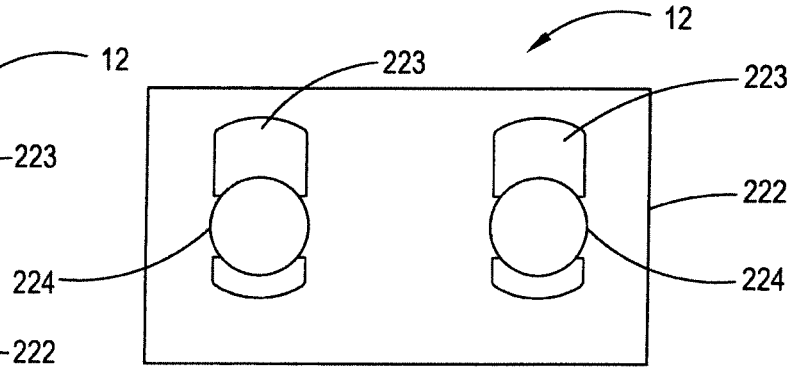
FIG. 11D is a top view of the interlocking plate of FIG. 11A.
Figure 12:
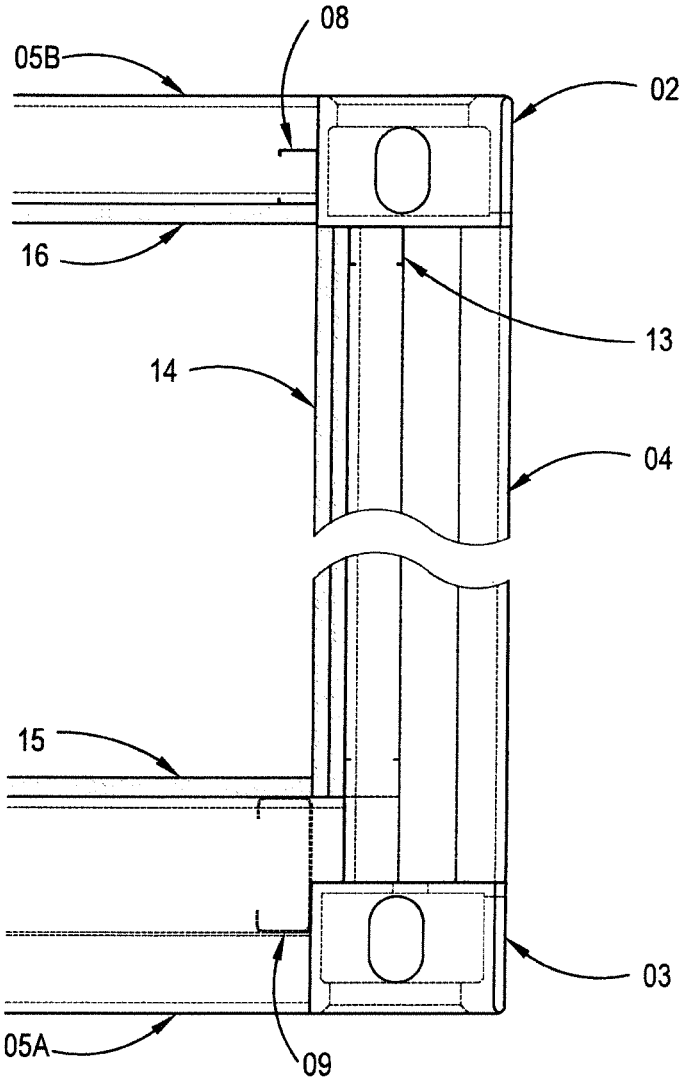
FIG. 12 is a partial side view of a pair of corner castings according to one embodiment of the invention.

Reference is made to FIGS. 8A to 8C which show various views of an elongate connection rod 11. The connection rod 11 includes an internally threaded socket head 210, a rod body 211 which is attached to the socket head 210 and includes an externally threaded tail. Threads 212, 213 of the socket head 210 and the tail are complementary. The socket head 210 has a larger external cross-sectional dimension e.g. diameter, than the rod body and tail, and a socket dimension adapted to threadably engage with a tail of another similar connection rod 11.

Reference is made to FIGS. 11A to 11D which show various views of an interlocking plate 12. The interlocking plate 12 includes a main plate 222 having at a plurality of openings 224 (or interlocking plate openings 224) therethrough. The interlocking plate openings 224 are suitably dimensioned to allow penetration of the internally threaded socket head 210. The interlocking plate 12 further includes guide projections 223 machined with engineering tolerance to be seated or fitted precisely within openings 215 and 219 of the castings shown in FIGS. 9A to 9D and 10A to 10D. The guide projections 223 are arranged on the main plate 222 and at least partially around the interlocking plate openings 224. The guide projections 223 are provided on opposed sides of the main plate 222 as lower and upper portions of the guide projections.

FIGS. 4A to 4H show various examples of multi-storey building structures constructed from prefabricated volumetric construction modules 1. Depending on the configuration of the building structure, the modules 1 forming the building structure may have similar, different or complementary configurations.

FIGS. 5A to 5E show various examples of multi-storey building structures constructed from prefabricated volumetric construction modules 1 which are secured to one or more core structures 106. The core structures 106 may be concrete, steel or other suitable structures which are built on-site.

Figure 6:
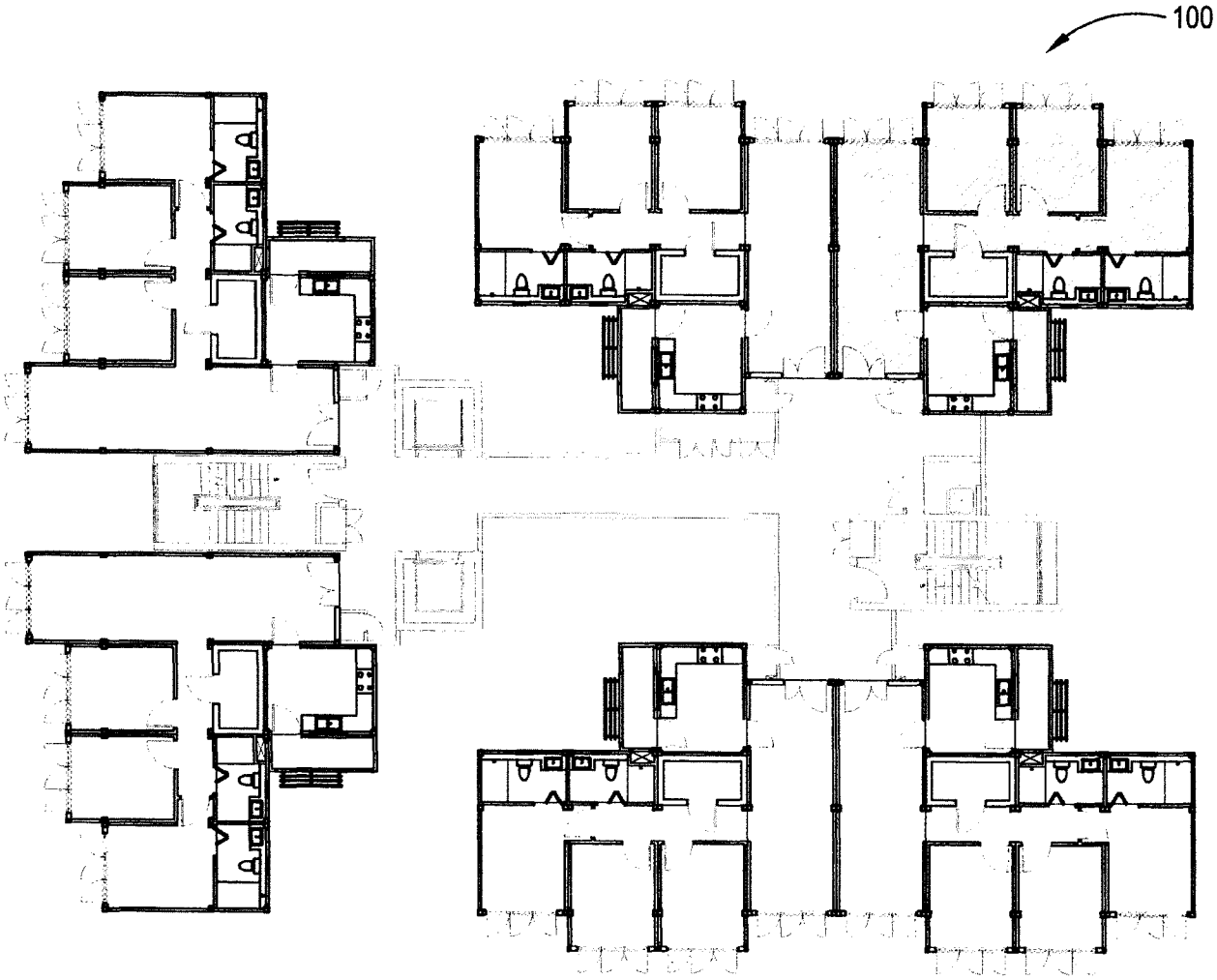
FIG. 6 shows modular floor layouts in an apartment building.
Figure 7:
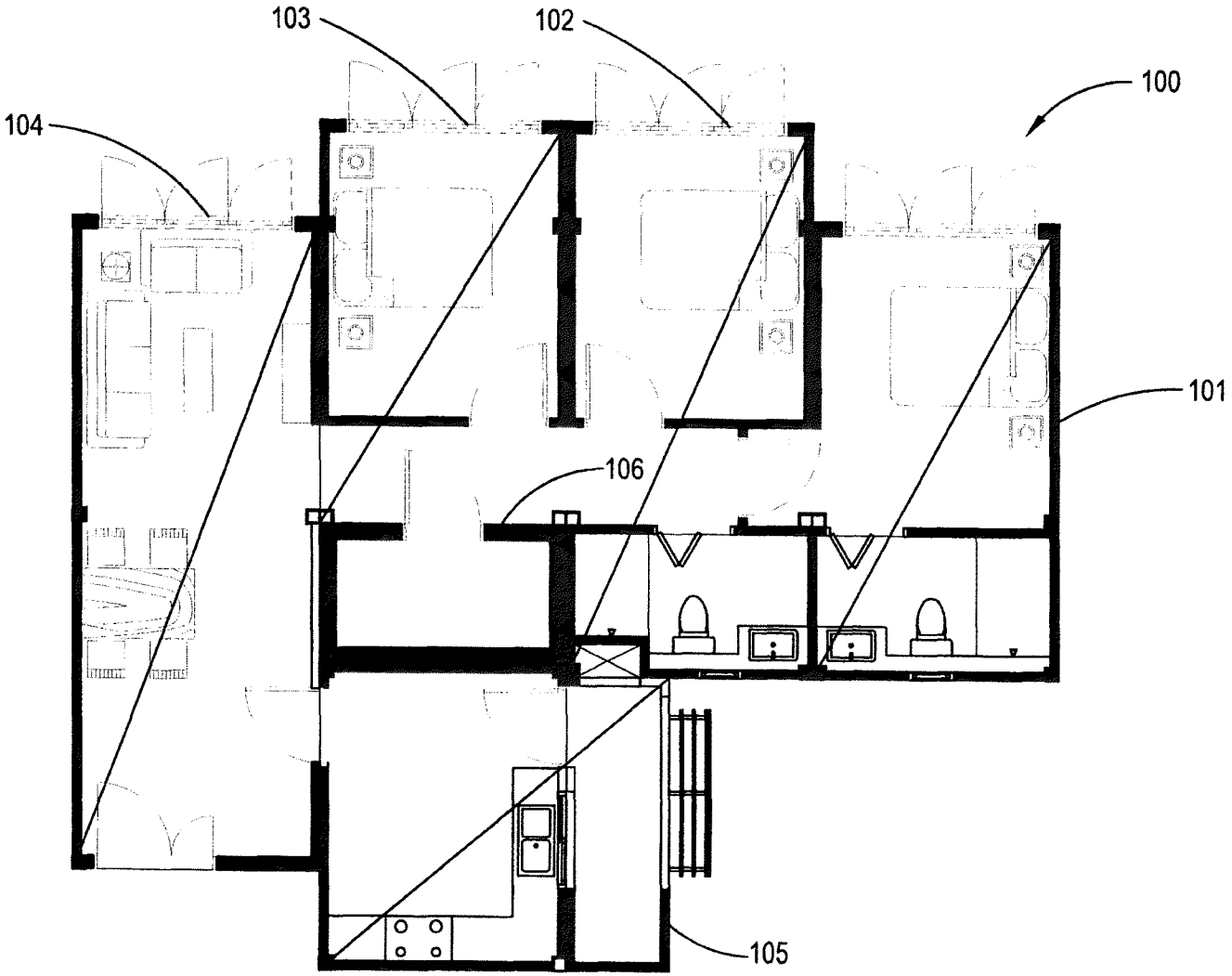
FIG. 7 is a close-up view of a modular floor layout from FIG. 6.

FIG. 6 shows modular floor layouts in an apartment building. As illustrated, each apartment unit 100 is provided as a pre-fabricated volumetric construction module. FIG. 7 is a close-up view of a modular floor layout of an apartment unit 100 of FIG. 6. However, it is also to be appreciated that in some embodiments each apartment unit may be provided by securing two or more pre-fabricated volumetric construction modules together.

According to one aspect of the invention, a building structure includes one or more stacks of vertically adjoining pre-fabricated volumetric construction modules 1 secured together. The components, structure and configuration of each module 1 are described in the foregoing paragraphs.

Figure 13:
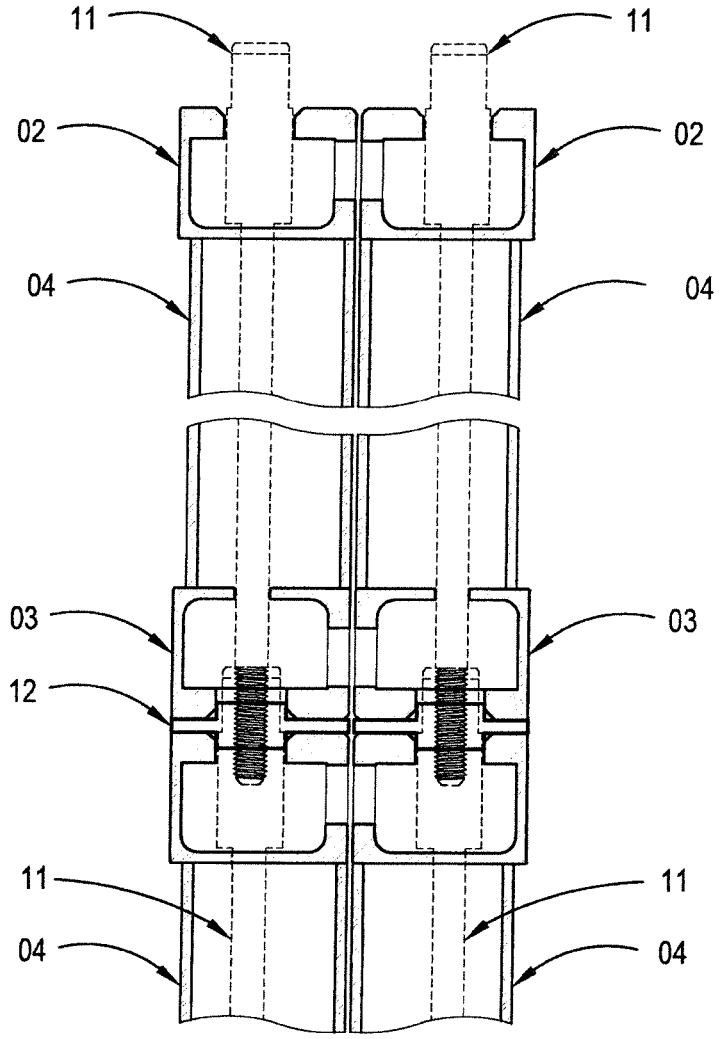
FIG. 13 is a partial side cross-sectional view of two pairs of corner castings according to one embodiment of the invention.
Figure 14:
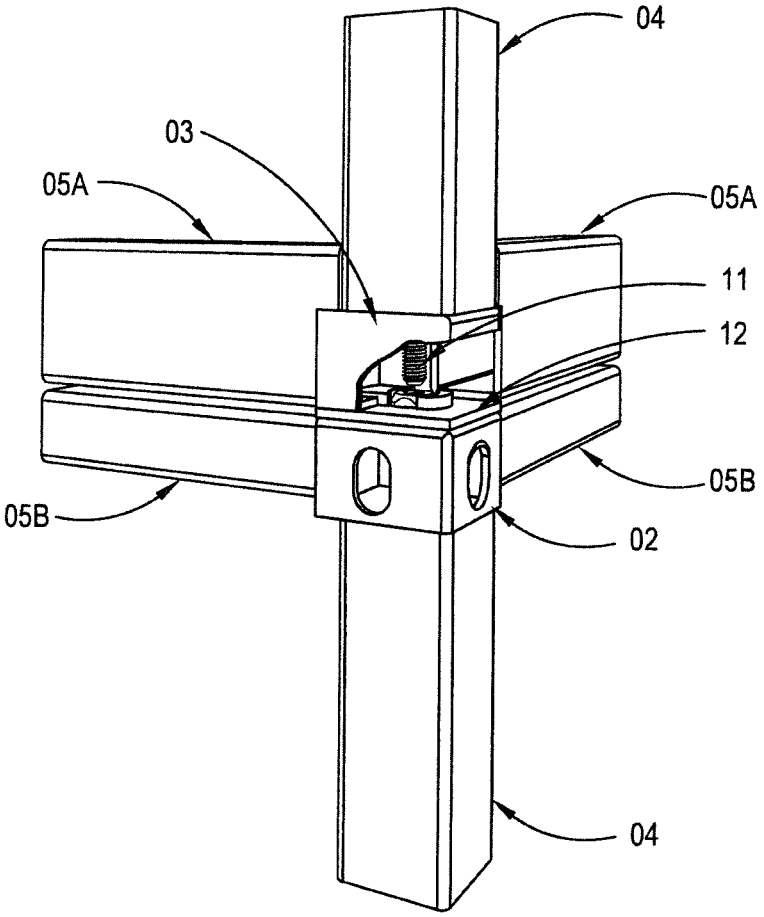
FIG. 14 is a partial perspective view of two corner castings of two modules being secured together.
Figure 15:
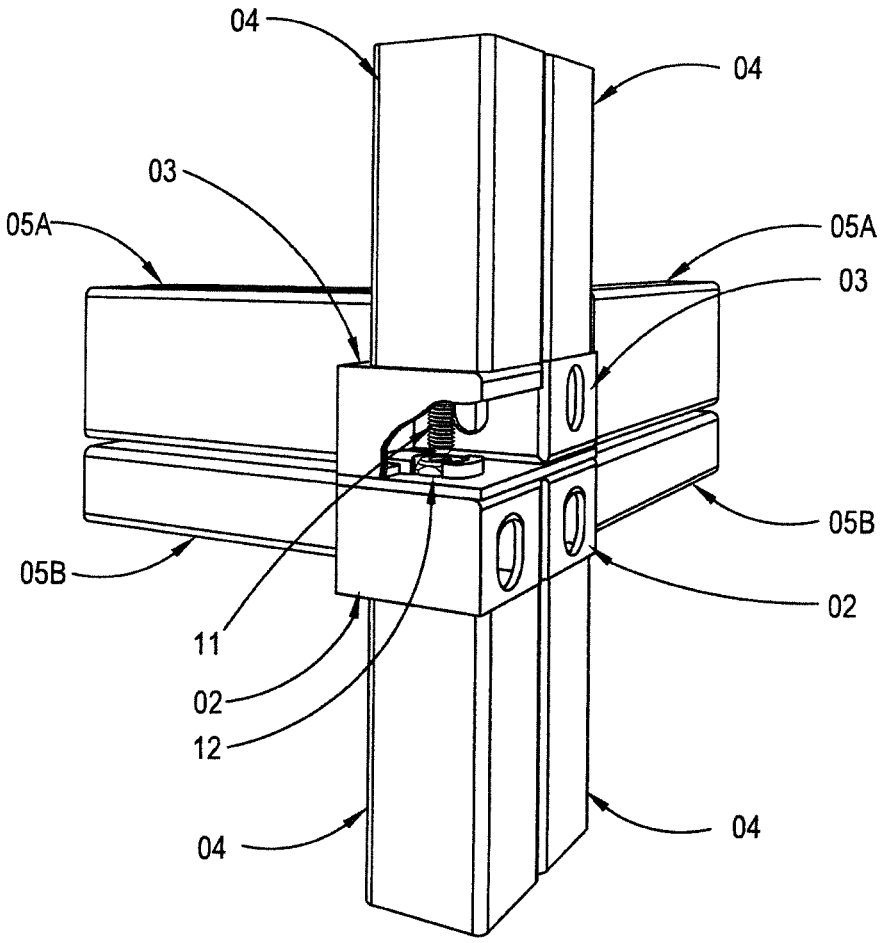
FIG. 15 is a partial perspective view of four corner castings of two modules modules being secured together.

Vertical securement is provided to vertically adjoining modules 1 within a stack (see FIGS. 13 to 15). Particularly, within a stack, e.g. a first stack, a plurality of first connection rods 11 secure an upper-level module 1 with an adjoining lower-level module 1. Each first connection rod 11 penetrates both an upper corner casting 2 and a lower corner casting 3 of a respective pair of corner castings at the upper-level module. The socket head 210 is engaged with the upper corner casting 2 at the upper-level module. The tail penetrates into an upper corner casting 2 of the adjoining lower-level module and is threadably engaged with an internally threaded socket head 210 of another connection rod which is engaged with the upper corner casting 2 of the adjoining lower-level module. Accordingly, the upper-level module is secured to the lower-level module.

This vertical securement between an upper-level and a lower-level module is replicated at various corner castings and throughout the first stack such that the modules within the first stack are vertically secured to one another.

At the bottom-most module or first level module of the first stack, additional base plate having a threaded socket may be arranged under each lower corner casting of the first level module to threadably engage with the connection rod penetrating the first level module. The additional base plates may be casted in non-shrink grouting and/or fixedly secured to a transfer slab, ground or foundation structure. This would secure the first level module to the ground or foundation.

In some embodiments, at least one interlocking plate 12 is arranged interposed between each upper-level module and its adjoining lower-level module. Socket head of a connecting rod engaged with the lower-level module is fitted within the interlocking plate opening 224 and guide projections 223 to prevent movement of the socket head including horizontal movement.

Figure 2B:
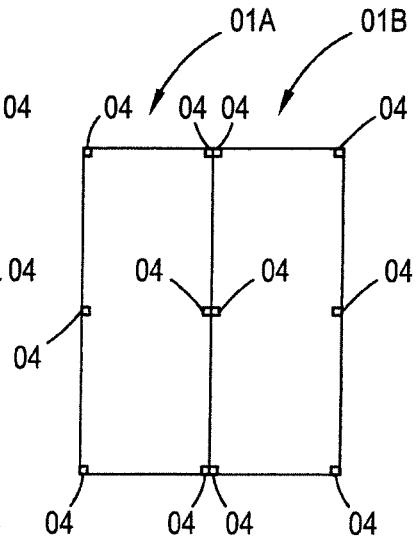
FIG. 2B shows a plan view of two adjoining modules and locations of corner castings in these modules.

In some other embodiments, the interlocking plate 12 provides horizontal securement to horizontally adjoining modules. Particularly, in a building structure constructed from at least two stacks of vertically adjoining modules, in addition to vertical securement of the vertically adjoining modules, horizontal securement of horizontally adjoining modules from two adjoining stacks are essential. For example, at a first and an adjoining second stack of vertically adjoining pre-fabricated volumetric construction modules, at least one interlocking plate is arranged overlapping or traversing the first and the second stack and interposed between horizontally adjoining upper-level modules and horizontally adjoining lower-level modules which vertically adjoin the horizontally adjoining upper-level modules. This may be illustrated by FIG. 2B which shows a plan view of two horizontally adjoining modules 1A, 1B provided as a first and a second stack. Interlocking plates 12 are arranged overlapping or traversing horizontally adjoining modules.

Figure 2C:
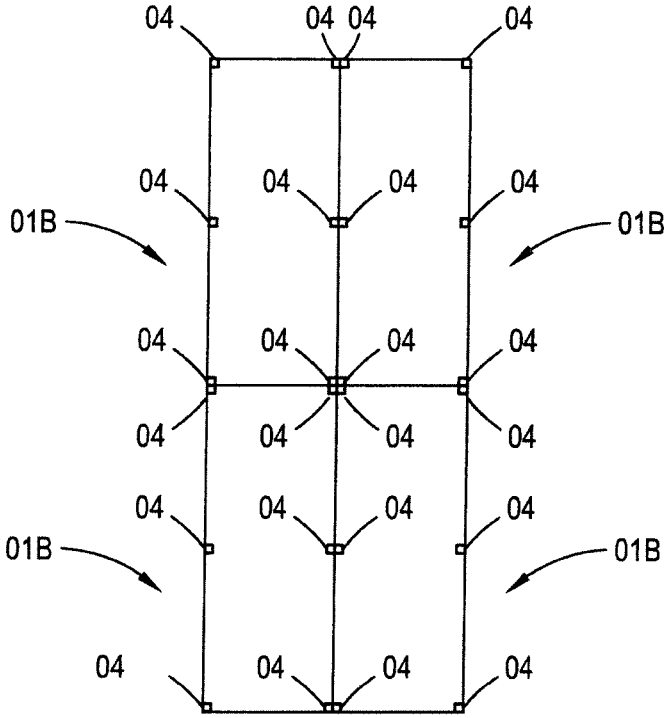
FIG. 2C shows a plan view of four adjoining modules and locations of corner castings in these modules.

Similarly, FIG. 2C shows a plan view of four adjoining modules and locations of corner castings in these modules. The four adjoining modules are provided in adjoining or different stacks. Interlocking plates 12 are arranged to overlap or traverse horizontally adjoining modules from adjoining stacks such that connection rods 11 securing the horizontally adjoining upper-level modules to the horizontally adjoining lower-level modules also penetrate the interlocking plate openings to provide horizontal securement between the horizontally adjoining upper-level modules and further between the horizontally adjoining lower-level modules. By overlapping or traversing an interlocking plate with modules from adjoining stacks, penetrating and fitting a socket head from the module below through the interlocking plate(s), the interlocking plate(s) restrain horizontal or lateral movement of horizontally adjoining modules.

In yet some other embodiments, the building structure includes a core structure 106 which is constructed on-site and secured to at least one of the modules or one of the stacks of modules.

According to one aspect of the invention, a method for constructing a building structure from pre-fabricated volumetric construction modules is provided and described with reference to a flow chart of FIG. 17 as well as FIGS. 16A to 16H.

Figure 17:
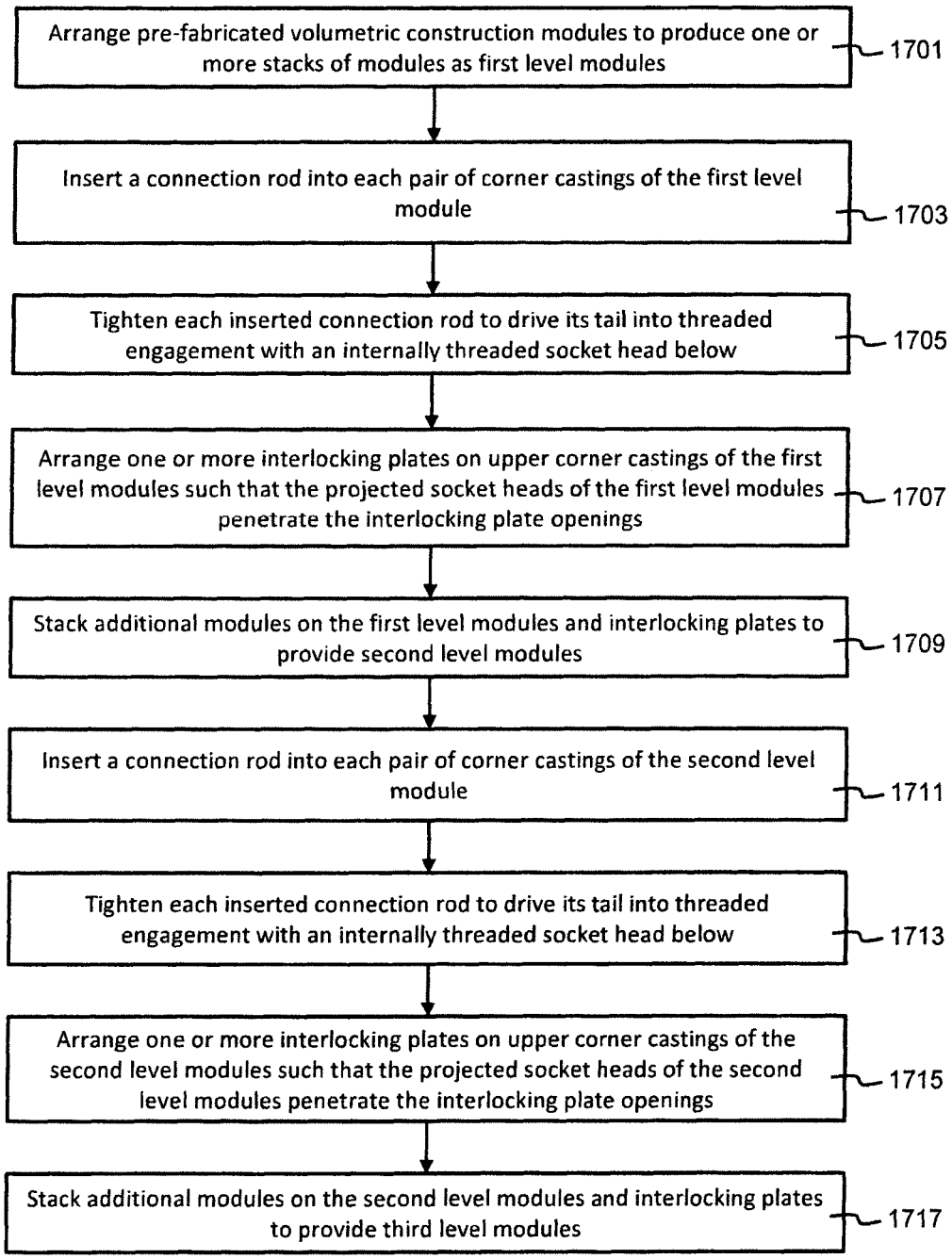
FIG. 17 shows a flow chart describing a method for constructing a building structure from pre-fabricated volumetric construction modules.

In block 1701 of FIG. 17, a plurality of pre-fabricated volumetric construction modules are provided and arranged to produce one or more stacks of modules. This may include arranging modules horizontally adjoining each other to provide first level modules.

In block 1703, connection rods are provided. A connection rod is inserted into respective upper corner casting and lower corner casting of each pair of corner castings of the first level module (see FIGS. 16A and 14). Each connection rod penetrates the upper corner casting, the column supporting the pair of upper and lower corner castings, and the lower corner casting. Insertion of connection rod is performed at each pair of upper and lower corner castings of the first level modules.

Figure 16A:
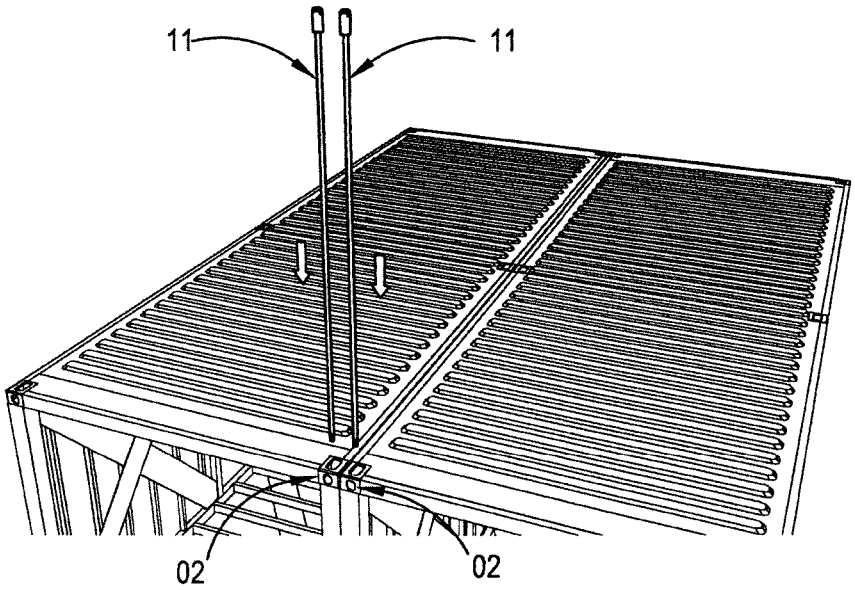
FIG. 16A shows insertion of rods into corner castings of a first and a second module forming a lower level.
Figure 16B:
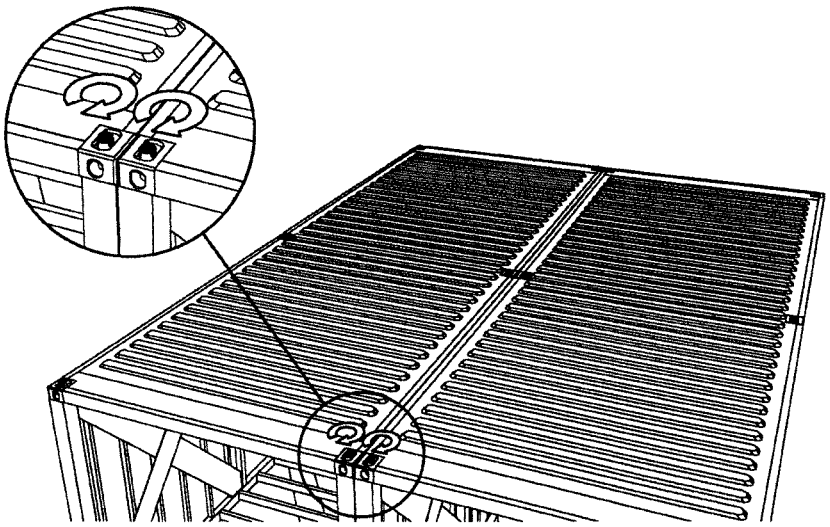
FIG. 16B shows tightening of rods after insertion in FIG. 16A.
Figure 16C:
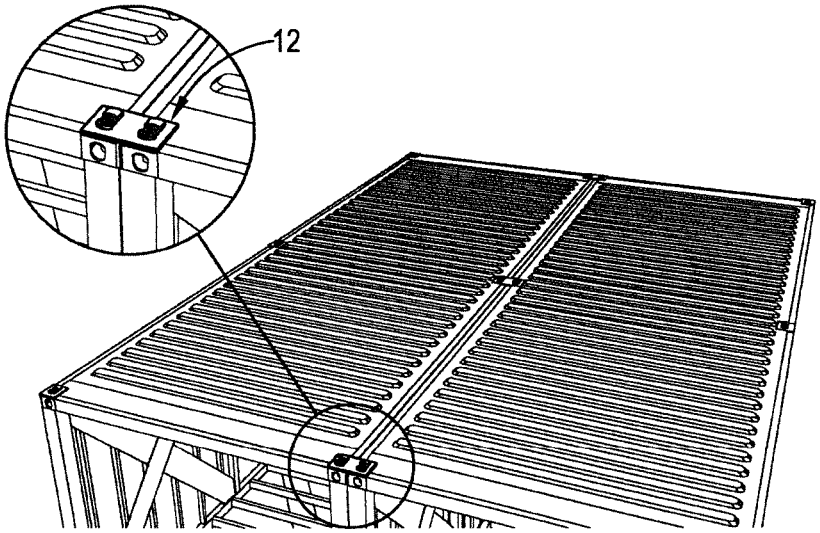
FIG. 16C shows the tightened rods housed within the corner castings of the first and the second module.

In block 1705, each inserted connection rod is turned at its socket head or tightened to drive its tail into threaded engagement with an internally threaded socket head arranged in the lower corner casting (see FIG. 16B). If the first level module is the bottom-most module of the stack, this internally threaded socket head may be provided at/by a base plate which is arranged under the bottom-most module and may be casted in non-shrink grouting and/or fixedly secured to a transfer slab, ground or foundation structure. The tightened connection rod is housed within the corner castings and column, except for a portion of the socket head projecting from the upper corner casting and free-standing (see FIG. 16C). The head socket of the connection rod is abutted against the upper corner casting of the first level module such that the connection rod is prevented from further vertical penetration and horizontal movement.

In block 1707, an interlocking plate is arranged on one or more upper corner castings of the first level modules such that the projected and free-standing socket heads of the first level modules are penetrated through and fitted within the interlocking plate openings and further such that lower portions of the guide projections are seated or fitted within a first upper plate opening of the upper corner casting of the first level module. In some embodiments, the interlocking plates overlap horizontally adjoining modules to provide horizontal securement therebetween. These interlocking plates are held in place by vertical forces due to weight of the upper module.

Figure 16D:
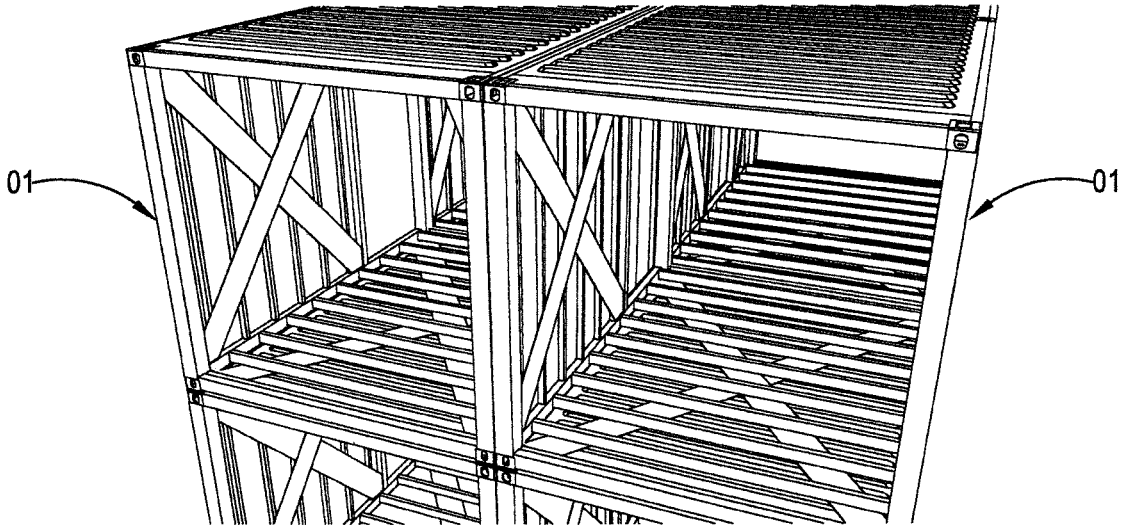
FIG. 16D shows a third and a fourth unsecured module stacked upon the first and the second module shown in FIGS. 16A to 16C to form an upper level.
Figure 16E:
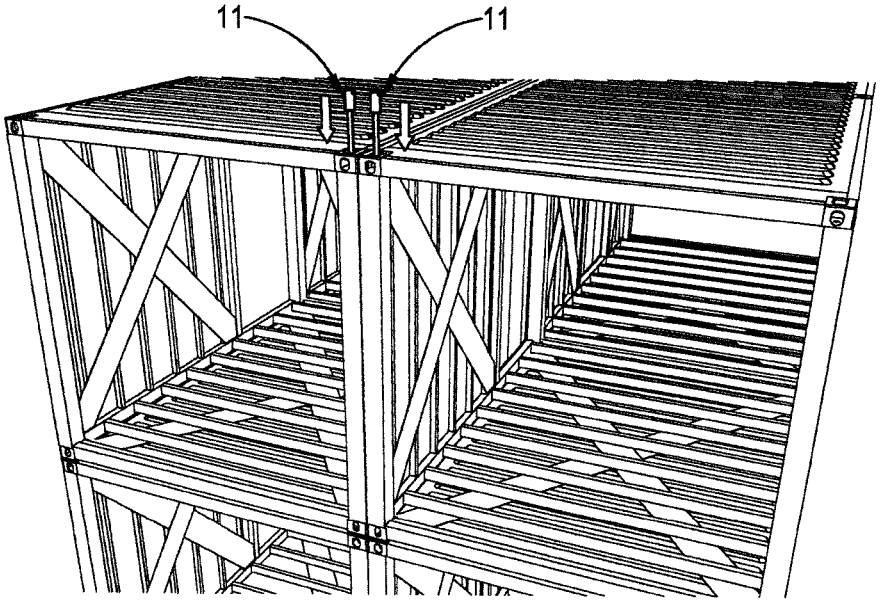
FIG. 16E shows insertion of rods into corner castings of the third and the fourth module.

In block 1709, additional modules are stacked on the first level modules and interlocking plates to provide second level modules (see FIG. 16D). During stacking of the second level modules, the guide projections on the interlocking plates provide a means for guiding the placement of the second level modules. Particularly, an operator lifts and lands a second level module onto the first level module such that the upper portions of the guide projections are received into second plate openings of lower corner castings of the second module and seated or fitted within the lower corner castings to prevent lateral or horizontal movement (see FIG. 13). After a second level module is stacked on the first level module, projected socket head from the first level module is received into the lower corner casting of the second level module and fitted therein (see FIG. 13).

In block 1711, connection rods are provided. A connection rod is inserted into respective upper corner casting and lower corner casting of each pair of corner castings of the second level module (see FIG. 16E). Each connection rod penetrates the upper corner casting, the column supporting the pair of upper and lower corner castings, the lower corner casting, and the interlocking plate, until the tail end of each connection rod comes into contact with a head socket below which is engaged with an upper corner casting of the first level module. Insertion of connection rod is performed at each pair of upper and lower corner casting of the second level modules.

Figure 16F:
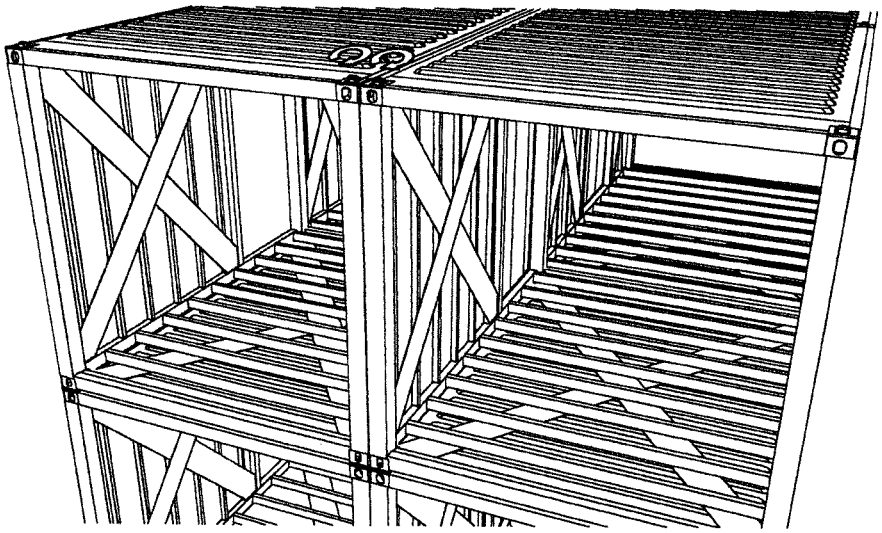
FIG. 16F shows tightening of rods after insertion in FIG. 16E.
Figure 16G:
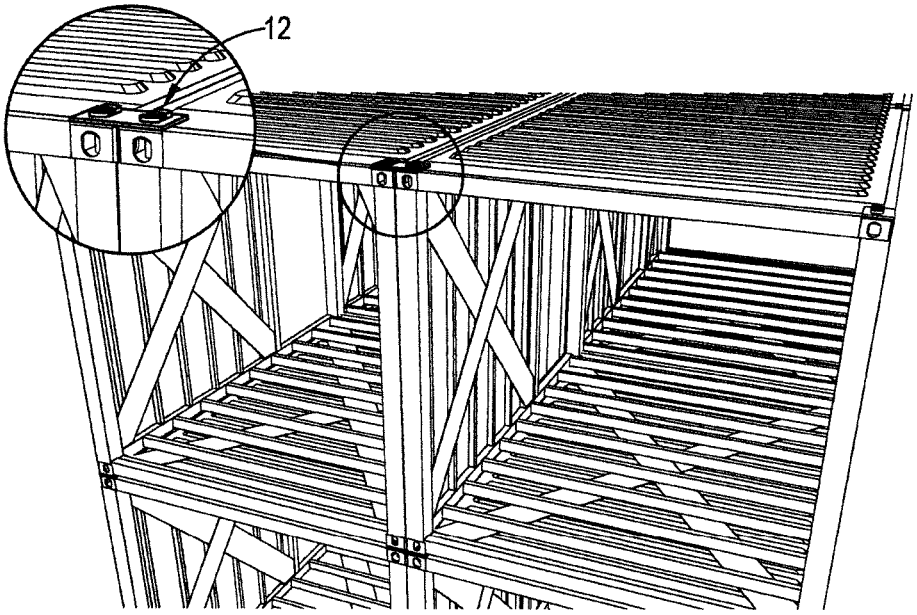
FIG. 16G shows the tightened rods housed within the corner castings of the third and the fourth module.

In block 1713, each inserted connection rod is turned at its socket head or tightened to drive its tail into threaded engagement with an internally threaded socket head which is arranged in the lower corner casting and belongs to a secured connection rod of the first level module (see FIGS. 16F and 13). The tightened connection rod is housed within the corner castings and column, except for a portion of the socket head projecting from the upper corner casting of the second level module (see FIG. 16G). The head socket of the connection rod is abutted against the upper corner casting of the second level module such that the connection rod is prevented from further vertical penetration and horizontal movement.

Figure 16H:
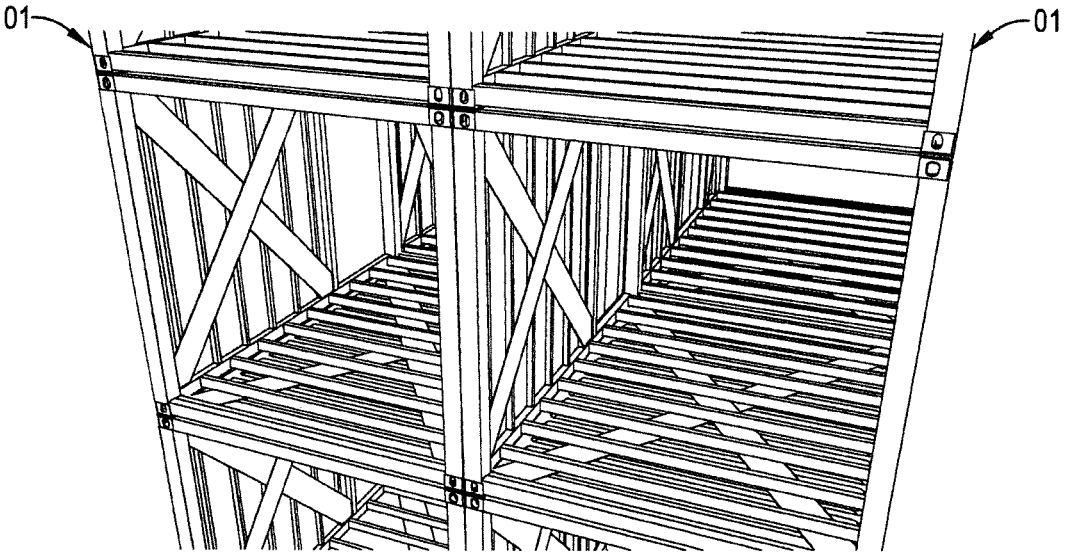
FIG. 16H shows a fifth and a sixth unsecured module stacked upon the third and the fourth module shown in FIGS. 16E to 16G to form a further upper level.

In block 1715, an interlocking plate is arranged on one or more upper corner castings of the second level modules such that the projected socket heads of the second level modules are penetrated through and fitted within the interlocking plate openings and further such that lower portions of the guide projections are seated or fitted within a first upper plate opening of the upper corner casting of the second level module (see FIG. 16H). In some embodiments, the interlocking plates overlap horizontally adjoining modules to provide horizontal securement therebetween.

In block 1717, additional modules may be stacked on the second level modules to provide third level modules (see FIG. 16H).

Embodiments of the invention provide several advantages including but not limited to the following:

- As the modules are relatively small in size, large or special factory and handling equipment is not needed thus resulting in efficiency and economies in fabrication, transporting, erecting and connecting. The self-standing or self-supporting modules can be erected quickly (without scaffolds, shoring, bracing, etc.) and directly and incorporate levelling and centering means which may be positioned prior to placement of the modules thereby to further accelerate the building erection process and to provide accuracy of placement of the modules.
- The modules provide an open system to allow builders customise their choice of local standard windows, doors, roofs and other equipment. The local standard windows and doors are preferably arranged between the modules, although they can, if desired, be fabricated and incorporated in the modules. Windows and doors set adjacent to the modules provide the advantage on connecting them to the modules on-site using standard connection details and further provide the construction tolerances required.
- Connection of building modules to each other, to floors and roofs, requires only the use of on-site connection details and practices.
- The modules can be designed to be of sufficient depth to define multi-purpose functional containers capable of enclosing and delineating kitchens, bathrooms, closets, other appliances and facilities, retail shelving, machines and show space for offices and retail buildings.
- The modules may be of a height which is a multiple of the normal floor-to-ceiling height of residential and commercial constructions. In multi-storey applications, such modules can retain their structural, self-supporting and self-standing capabilities while serving as full height exterior wall systems or as interior wall systems of a divider nature. Such modules desirably have the capabilities of using normal concrete inserts, dry wall panels with vertical structures to support floors of pre-stressed slabs, or metal deck floors of steel structures.

The engineer transforming a single steel component forming 2D frames further refine into a 3D module. The modules are assembled together by means of automation welding machine and a robotic 3D assembling process for accuracy, precision and better quality. This process eliminates rework, improves productivity and removes human fatigue.

- The number of sizes for modules for wide design flexibility is small, example from 3 to 5 types. The modules can be made simply and created by linking them together. These three to five sizes of modules can be interrelated, connected and positioned to create a virtually limitless set of room or enclosure configurations.

The corner-casting guide on the interlocking plate serves as the perpendicular guide to receive the bottom corner casting of the upper modules in its vertical plane. These interlocking plates are installed on the top of each module, checked for levelling and lateral tolerance before the top modules are lowered to match and fit perfectly during an installation operation. Therefore, the erection process is significantly speeded up, and costly crane and equipment stay are utilized more efficiently. The need for highly skilled labour is greatly reduced as compared with traditional methods, this being a great advantage in regions where there is a shortage of skilled labour or where labour costs are exceedingly high.

Vertical securement is provided to vertically adjoining modules. Horizontal securement is provided by the interlocking plate to horizontally adjoining modules.

In a further embodiment the use of concrete precast panels may replace the steel framework of the arrangement of previous embodiments.

Being pre-cast panels, these may be manufactured under controlled conditions, such as in a factory environment. Said panels are then assembled to form building units or modules.

Each of said modules may form an occupiable space, or alternatively form a portion of a larger space. By assembling, aligning and coupling said modules, the invention provides the flexibility to form said building structures in an efficient manner. To maintain a high degree of precision in construction, the modules are also formed in a controlled environment, such as a factory, and thus removing the necessity for that level of precision to be achieved on site where conditions and expertise are considerable more difficult. For convenience, the factory space may be proximate to the construction site, in order to manage transportation costs of the modules.

The efficiency provided by the present invention resides in, not only their manufacture under controlled conditions, but in transport and assembly of the modules to achieve a vast range of building structures from a collection of 2 dimensional panels. Accordingly, a key advantage of the invention according to this invention may include the use of a finite number of pre-cast concrete panel units which are designed and arranged so as to form building structures of great complexity.

The adaptation of precise engineering may produce a structure with a structural integrity that is equivalent to that of conventional concrete system while decreasing construction time and increasing productivity.

A highly efficient automated bolting system may be used in the assembly of the modules from the building panels. To this end, a dowelled or bolted system along the peripheral edge of the panels may be used to allow the automated bolting system to align the panels, then sequentially bolt the panels into place, before moving to the next panel to panel engagement. The use of the automated bolting system, which aligns and bolts the panels can only be used under controlled conditions, and represents a marked improvement on traditional precast systems. It reduces the logistic and manpower requirements significantly and eliminates rework processes or corrections due to human error. To this end, the present invention, at the panel to module assembly stage may yield all the advantages precast construction was intended to provide, but never really delivered. Implementation of the present invention may therefore provide a significant step towards "manufactured construction", and not merely the fabrication of building components as represented by the prior art.

To date, precast construction is little more than providing construction materials which are then sent to site, with building standards and efficiencies still subject to the vagaries of onsite construction. The concept of "manufactured construction", which the present invention seeks to achieve may allow for factory level precision, which is achievable onsite.

The transportation of each complete module may be facilitated made easy with the incorporation of the binding member, which may be the aforementioned connection rods, on the four corners of each modules. The connection rods at the top and bottom of the four corners may allow shipping carriers and international ports to lift, shift, load and transport these modules with standard equipment and trailers. This incorporation reduces tedious transportation on the road that translates to cost savings on logistics and delivery time.

To this end, the invention may include a prefabricated prefinished volumetric construction system, including a mechanical production line arranged to align a first plurality of slotted holes on a first panel with a second plurality of slotted holes on a second panel; and an automated bolting machine arranged to insert a bolt through each of the aligned first and second plurality of slotted holes.

The method of prefabricated prefinished volumetric construction may include aligning a first plurality of slotted holes on a first panel with a second plurality of slotted holes on a second panel using a mechanical production line; and inserting a bolt into each of the aligned first and second plurality of slotted holes using an automated bolting machine.

Such a system and method utilizes automation to increase productivity and reliability of the prefabricated prefinished volumetric construction. For example, the automated bolting machine reduces the amount of manpower and time required for the bolting process, and improves the structural integrity of the resultant precast module.

The prefabricated prefinished volumetric construction system according to the first broad statement, wherein each of the first and second plurality of slotted holes comprises a ferrule.

The method of prefabricated prefinished volumetric construction may include each of the first and second plurality of slotted holes comprising a ferrule.

Such an arrangement allows for a tight joint to be formed. Specifically, the bolt will be inserted into the slotted holes where the ferrules are located. The bolts are then tightened so as to drive the thread of the bolts into the ferrules, thereby creating a tight seal.

Figure 18:
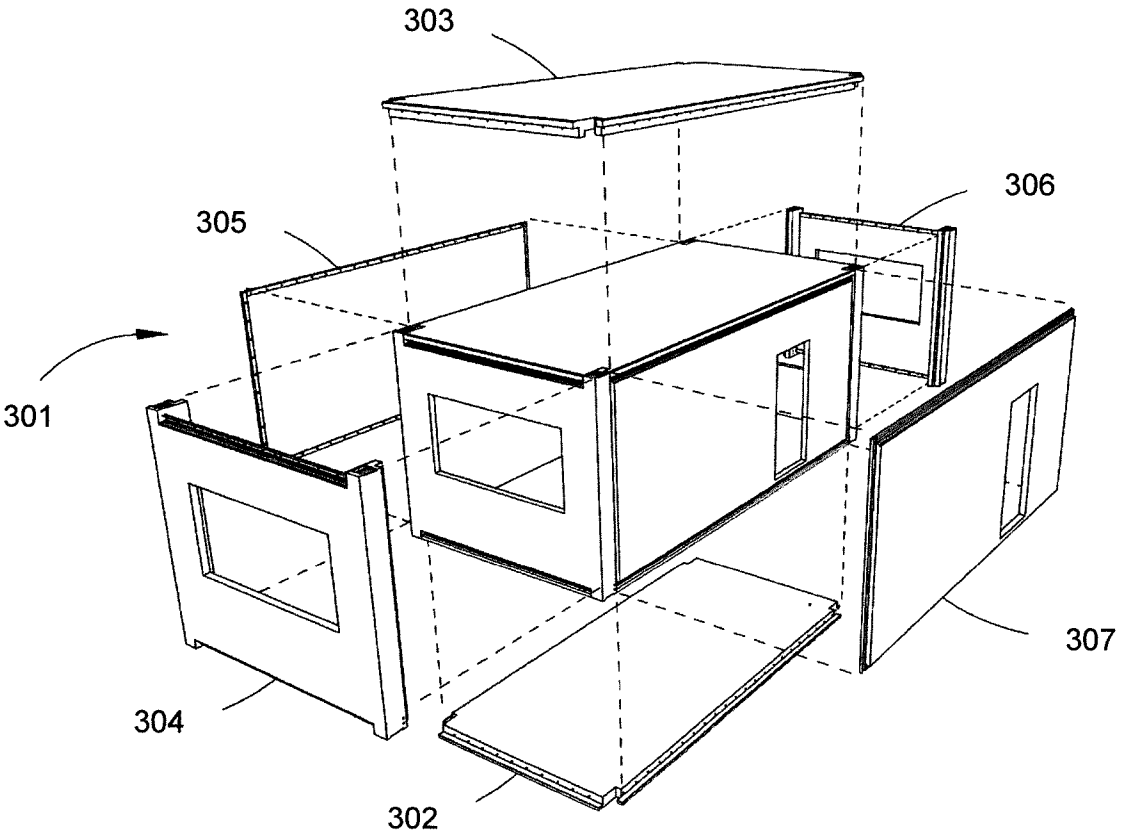
FIG. 18 shows an exploded view of prefabricated volumetric module according to one embodiment of the present invention.
Figure 19:
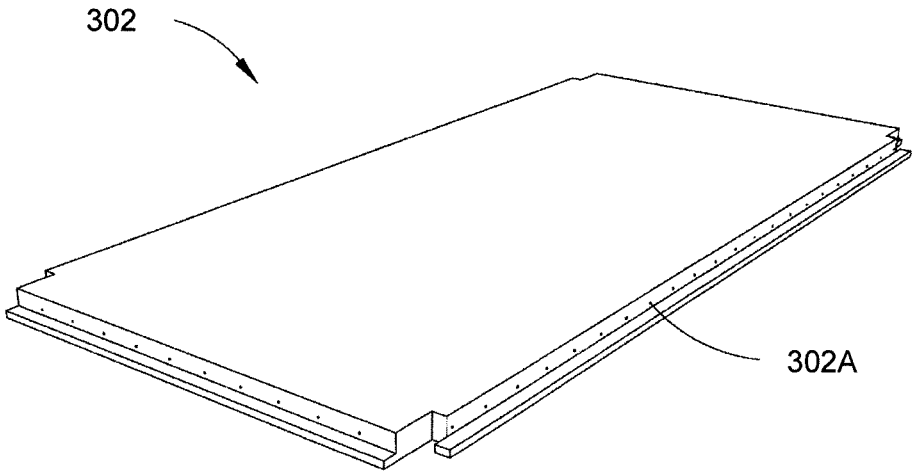
FIG. 19 shows a perspective view of the adjoining back slab of the module according to one embodiment of the present invention.
Figure 20:
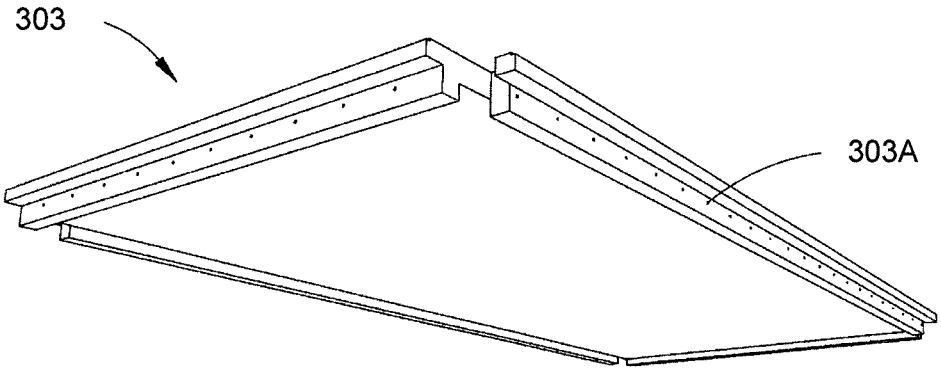
FIG. 20 shows a perspective view of the adjoining roof slab of the Solibox module according to one embodiment of the present invention.

Reference is now made to FIGS. 18 to 30, which disclose certain examples of the implementation of this embodiment. In particular, FIG. 18 shows an assembled module 301 comprising a base panel 302, wall panels 304 to 307 and a roof panel 303.

FIGS. 19 to 24 show the various panels, in particular the floor panel 302 which includes a stepped peripheral edge 302A having dowelled or bolted connectors around the peripheral edge for receiving the wall panels as shown in FIGS. 21 to 24. In this embodiment, the connection between panels may be dowelled to act as alignment prior to finally bolting, bolted along each edge or a combination of both. The panels may have a stepped peripheral edge. Alternatively some panels may be stepped, while other panels may have a flush edge and so arranged to fit within this step. To this end, alignment of the panels may also be achieved through a profiling of the peripheral connection edges. That is when coupling panels, the peripheral edges may be shaped so as to allow a single positional engagement, with this positional engagement held in place by either the doweling or bolted connections.

Figure 21:
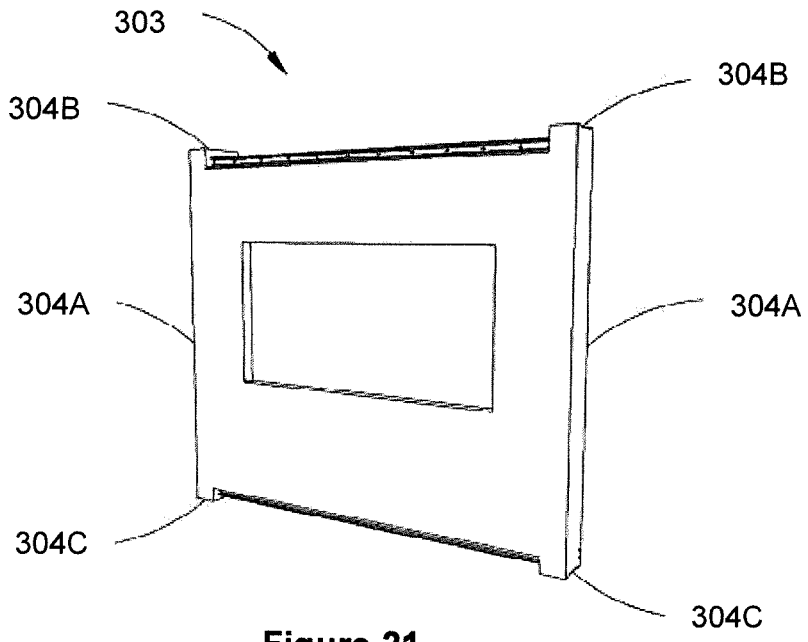
FIG. 21 shows a perspective view of the wall panel A according to one embodiment of the present invention.
Figure 22:
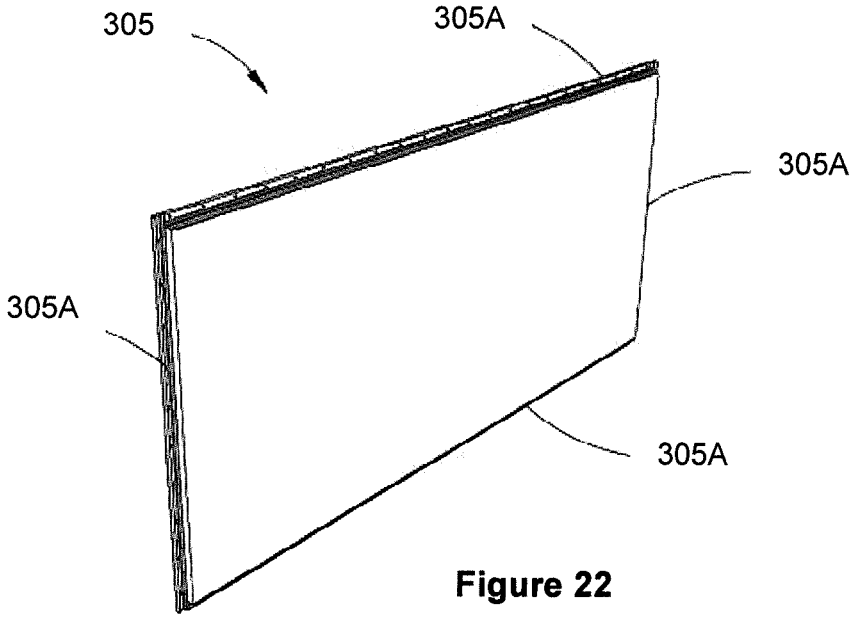
FIG. 22 shows a perspective view of the wall panel B according to one embodiment of the present invention.
Figure 23:
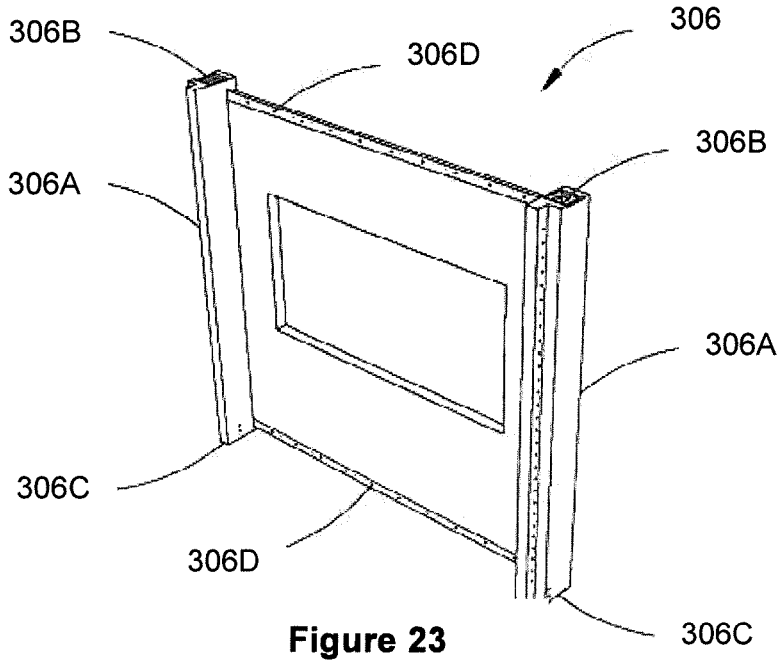
FIG. 23 shows a perspective view of the wall panel C according to one embodiment of the present invention.
Figure 24:
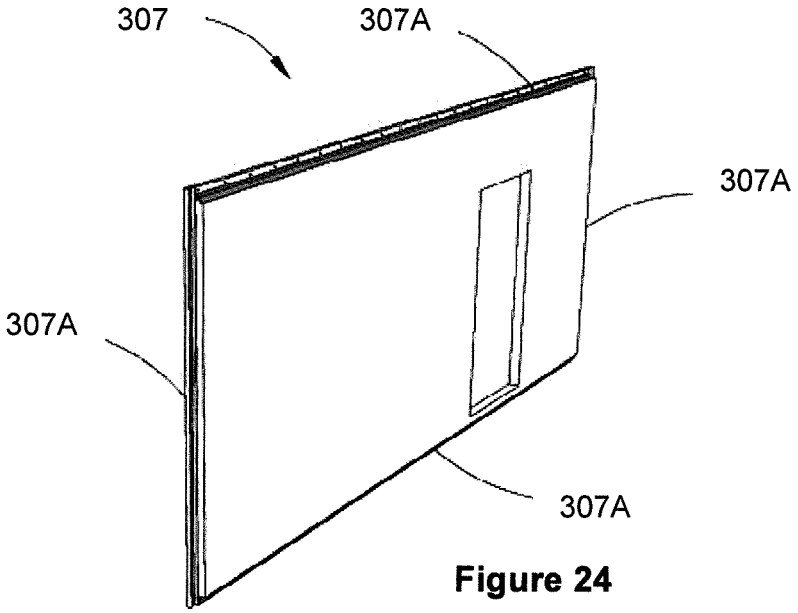
FIG. 24 shows a perspective view of the wall panel D according to one embodiment of the present invention.

Taking an end wall panel A shown in FIG. 21, the panel 304 includes vertical edges 304A, lower connection portions 304C and upper connection portions 304B. Similarly, as shown in FIG. 22, the wall panel B representing a longitudinal edge of the module 301 includes stepped peripheral edges 305A, again with recesses to receive dowelled or bolted connectors spaced along the peripheral stepped edge 305A. The opposing wall panel C shown in FIG. 23 is of similar construction to the end wall panel A of FIG. 21 having lower connecting portions 306C, upper connecting portions 306B, For instance, said connecting portions may be casters for engaging the adjacent panels, and/o receiving a binding member for later assembly to form a building structure. The end wall panels C of FIG. 23 further include horizontal connecting edges 306D and vertical connecting edges 306A. Finally, a further longitudinal wall panel D as shown in FIG. 24 includes the panel 307 with stepped peripheral edges 307A to receive connectors from corresponding panels. The final panel being the roof panel 303 includes corresponding peripheral edge 303A for connection with the various horizontal connecting edges of the wall panels.

Figure 25A:
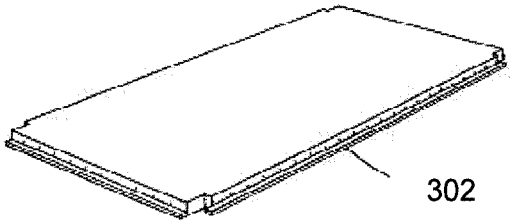
FIG. 25A shows a perspective view of the floor slab panel prior to bolting according to one embodiment of the present invention.
Figure 25B:
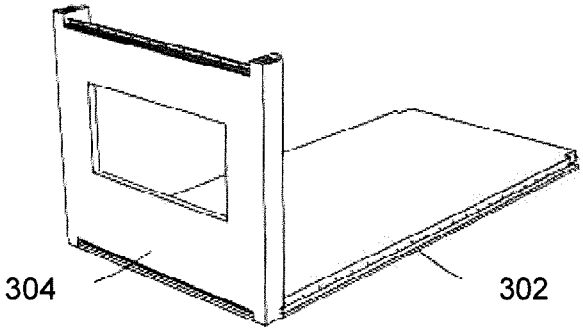
FIG. 25B shows a perspective view of the wall panel A bolted to the floor slab panel according to one embodiment of the present invention.
Figure 25C:
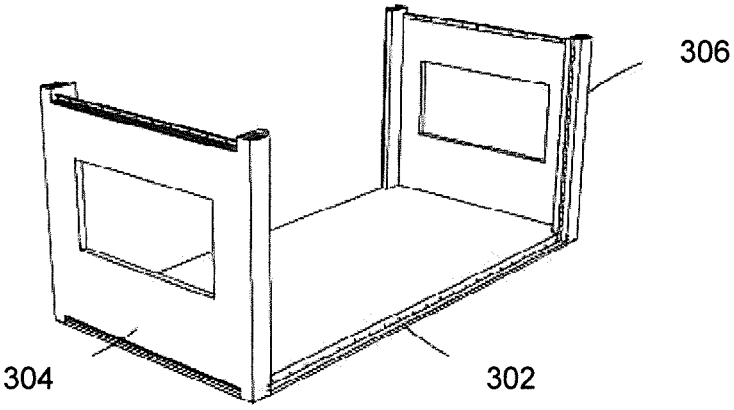
FIG. 25C shows a perspective view of the wall panel C bolted to the floor slab panel according to one embodiment of the present invention.
Figure 25D:
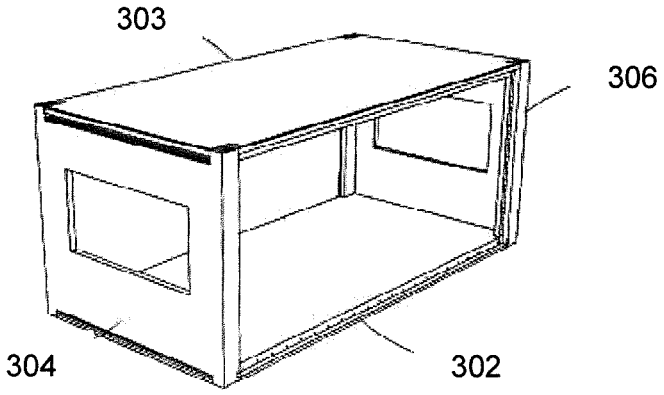
FIG. 25D shows a perspective view of the wall panel B bolted to the floor slab panel according to one embodiment of the present invention.
Figure 25E:
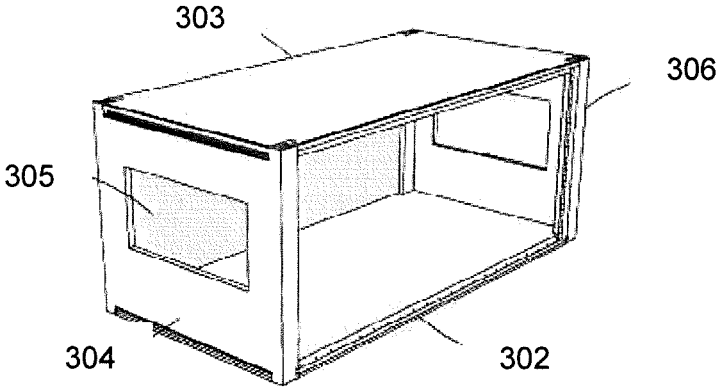
FIG. 25E shows a perspective view of the wall panel D bolted to the floor slab panel according to one embodiment of the present invention.
Figure 25F:
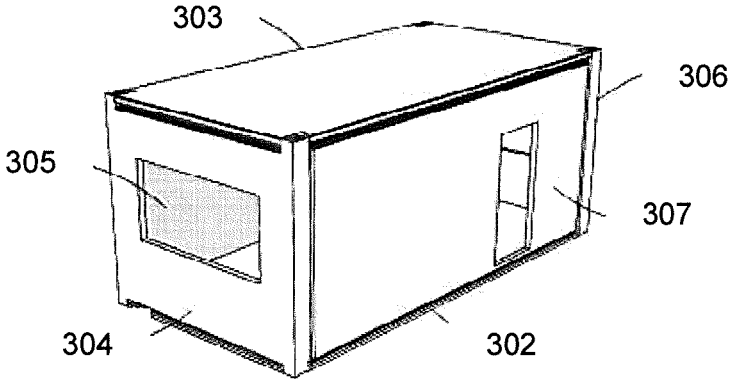
FIG. 25F shows a perspective view of the roof slab bolted to the module according to one embodiment of the present invention.

FIGS. 25A to 25F show a sequential arrangement for the construction of the module according to one embodiment. Firstly, the floor panel 302 is placed followed by end walls 304 and 306. These are held in place by connecting to the roof panel 303 with all four panels now joined along the dowelled stack peripheral edges of the panels. As shown in FIGS. 25E and 25F, the longitudinal panels 305 and 307 are then connected to the structure to form the finished module. As the respective panels are placed, the automated bolting device may include an alignment arrangement to hold the panels in place, as the bolts are placed in the recesses located along the peripheral edges of each panel. It will be appreciated that, for bolts rather than dowels, the recesses may be threaded metal sections embedded in the precast concrete panel.

It will be appreciated that the construction of such a module may take a number of different forms in order to create modules of different size, shape and functionality.

Figure 26:
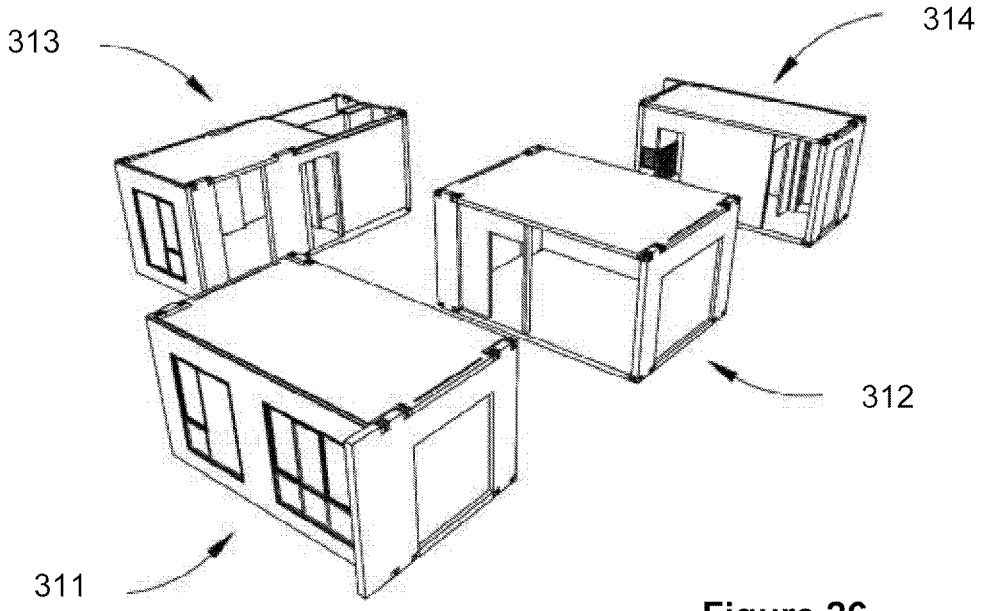
FIG. 26 shows a perspective view of various modules of varied sizes that can be adjoined to one another according to one embodiment of the present invention.
Figure 27:
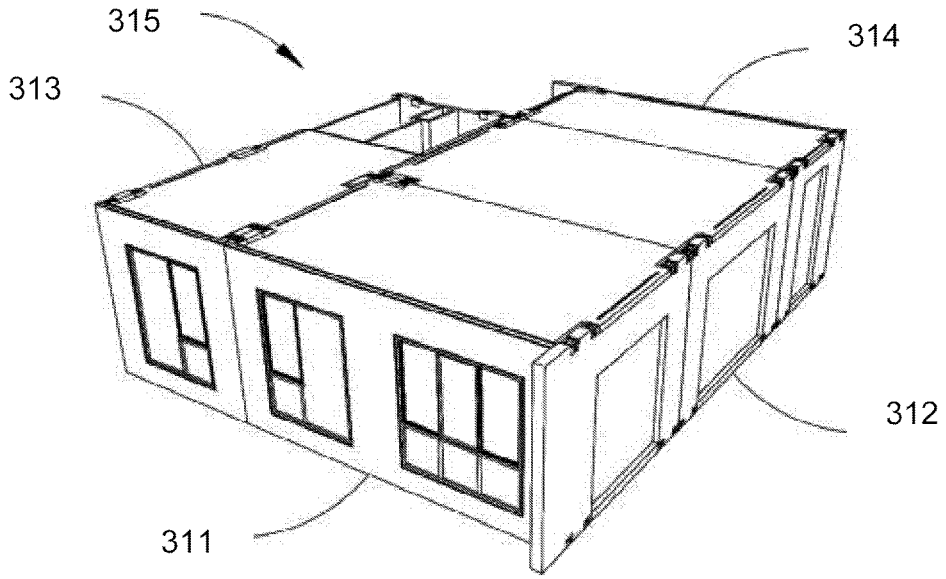
FIG. 27 shows a perspective view of a complete apartment made up of varied sized Solibox modules adjoined to one another according to one embodiment of the present invention.
Figure 28A:
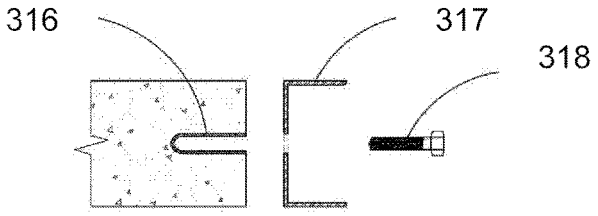
FIGS. 28A and 28B are various views of a partial side cross-sectional view of two pairs of corner castings according to a further embodiment of the invention.
Figure 28B:
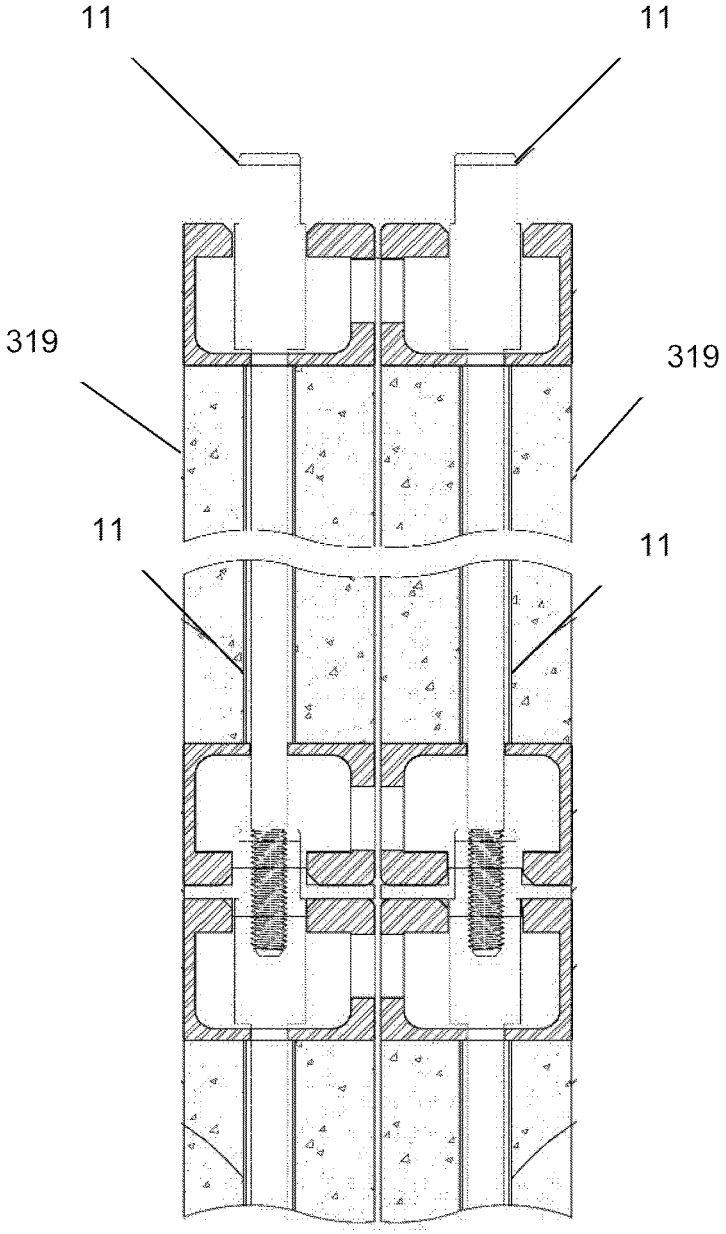

FIGS. 26 and 27, for instance, show an array of modules 311 to 314 which are placed adjacent to each other and aligned through aligning connectors to form a building structure 315. To complete the construction process, a binding member is then placed at critical locations around the structure to bind the modules together to form the unitary building structure. As previously outlined, this arrangement allows for the modular formation of larger building structures. Whilst the module, according to the embodiment shown in FIGS. 1A and 1B, can partially form building structures as sown in FIGS. 4A to 4H and 5A to 5E, equally the building module according to the embodiment shown in FIG. 18 can equally form such building structures when placed accordingly and turn into a unitary building structure on coupling with a binding member.

One such binding member that can be used according to the module embodiment of FIG. 18 is the connection rod as shown in FIGS. 8A to 8C.

Figure 29:
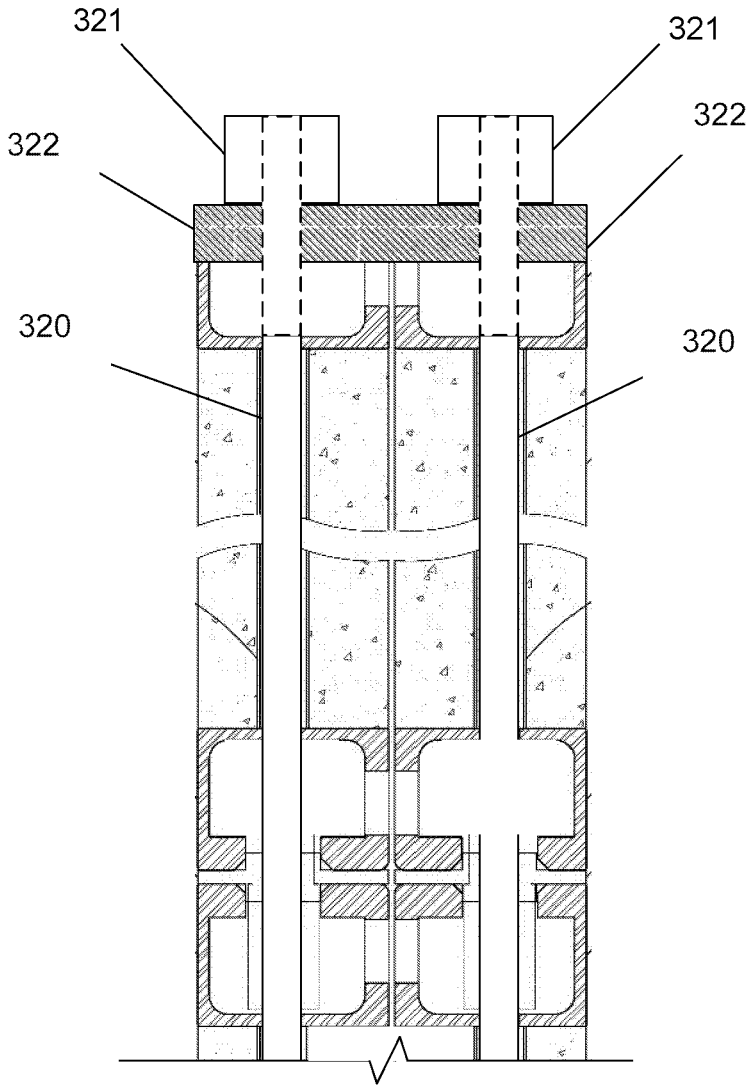
FIG. 29 is an elevation cross-sectional view of two pairs of corner castings according to a further embodiment of the invention.

As an alternative arrangement the binding member may comprise a series of anchor blocks and post-stressing cables locating at the peripheral edges of the panels of the placed modules, with anchor blocks positioned at the connections portions of the panels. For instance the corner castings may comprise end anchors arranged to resist a post-stressed cable connecting adjacent modules and binding said modules into the unitary structure. Such an arrangement is shown in FIG. 29, which is alternative to the use of connecting rods as the binding member, as shown in FIG. 13. For this alternative embodiment, the end connections 322 are modified to receive an anchor 321, which act to resist the post-stressing of the cable 320. Thus when the various modules have been placed and aligned, the cable is stressed so as to couple the placed discrete modules to form a unitary building structure.

It is to be understood that the embodiments and features described above should be considered exemplary and not restrictive. Many other embodiments will be apparent to those skilled in the art from consideration of the specification and practice of the invention. Furthermore, certain terminology has been used for the purposes of descriptive clarity, and not to limit the disclosed embodiments of the invention.

The invention claimed is:

1. A unitary structure defining a plurality of internal occupiable spaces, the unitary structure comprising:

a plurality of adjacent modules, each of the plurality of adjacent modules having at least one occupiable space;

at least one binding member arranged to span vertically across and couple vertically adjacent modules; and an interlocking plate arranged to span horizontally across and couple horizontally adjacent modules, wherein each of the plurality of adjacent modules further comprises a plurality of structural panels, each of the plurality of structural panels are assembled with adjacent structural panels by a plurality of mechanical connectors, wherein at least one edge of one module is aligned with a corresponding edge of the adjacent modules and peripheral connection edges of the structural panels are shaped to allow a single positional engagement, held in place by connections having dowelling or bolts, wherein the binding member comprises a first rod arranged to be inserted through at least one edge of a lower-level module, and a second rod arranged to be inserted through at least one edge of an upper-level module, the first and second rods comprise an internally threaded end and an externally threaded end, the internally threaded end and the externally threaded end are arranged to be complementary with each other, wherein the externally threaded end of the second rod is arranged to be inserted into the internally threaded end of the first rod, and wherein the interlocking plate has at least one opening and at least one guide projection arranged at least partially around the at least one opening and interposed between the upper-level module and the adjoining lower-level module, wherein an internally threaded socket head of the second rod is fitted within the at least one opening, and wherein an upper portion and a lower portion of the guide projection are fitted within a lower corner casting of the upper-level module and an upper corner casting of the lower-level module respectively so as to guide the placement of the adjacent modules and prevent lateral or horizontal movement of the adjacent modules.

2. The unitary structure according to claim 1, wherein the plurality of structural panels comprises at least a roof panel and a floor panel.

3. The unitary structure according to claim 2, wherein the floor panel of an upper-level module is positioned on the roof panel of a lower-level module.

4. The unitary structure according to claim 3, wherein the binding member is arranged to couple adjacent modules on the roof panel of the module.

5. The unitary structure according to claim 1, wherein the plurality of mechanical connectors comprises a bolt and ferrule system.

6. The unitary structure according to claim 1, wherein at least some of the plurality of structural panels comprise stepped peripheral edges to receive flush edges.

* * * * *